US008001747B2

(12) United States Patent
Pluckrose et al.

(10) Patent No.: US 8,001,747 B2
(45) Date of Patent: Aug. 23, 2011

(54) METHOD AND APPARATUS FOR FORMING AND FILLING FLEXIBLE PACKAGING

(75) Inventors: Derrick Pluckrose, Wellington Point (AU); Richard James Bacchus, Yeronga (AU); Richard James Aislabie, Eight Mile Plains (AU); Chris Robert Hall, Greenbank (AU); Hugh Leslie Hall, Sunnybank Hills (AU)

(73) Assignee: Kencan Australasia Pty Ltd., Willawong, Quennsland (AU)

( * ) Notice: Subject to any disclaimer, the term of this patent is extended or adjusted under 35 U.S.C. 154(b) by 536 days.

(21) Appl. No.: 11/573,533

(22) PCT Filed: Aug. 12, 2005 (Under 37 CFR 1.47)

(86) PCT No.: PCT/AU2005/001213

§ 371 (c)(1), (2), (4) Date: Apr. 6, 2008

(87) PCT Pub. No.: WO2006/015447

PCT Pub. Date: Feb. 16, 2006

(65) Prior Publication Data

US 2009/0272079 A1 Nov. 5, 2009

(30) Foreign Application Priority Data

Aug. 13, 2004 (AU) ..... 2004904579

(51) Int. Cl.
*B65B 1/04* (2006.01)

(52) U.S. Cl. ..... 53/452; 53/284.7; 53/468; 53/469; 53/571

(58) Field of Classification Search ..... 53/452, 53/457–459, 467–469, 202, 567, 473, 479, 53/571, 284.7, 558
See application file for complete search history.

(56) References Cited

U.S. PATENT DOCUMENTS 2,754,644 A * 7/1956 Bergeron et al. ..... 53/455
3,172,796 A * 3/1965 Gulker ..... 156/269
(Continued)

FOREIGN PATENT DOCUMENTS

DE 3543725 3/1987
(Continued)

*Primary Examiner* — Thanh K Truong
(74) *Attorney, Agent, or Firm* — Thompson Coburn LLP

(57) ABSTRACT

An apparatus (100) for forming and filling flexible bags with a viscous product, said apparatus including: a support (104) for a supply (106) of a tubular web (108) of flexible packaging material; at least one guide (110) for accepting from said supply a continuous feed of the tubular web of packaging material; a bag forming (300) assembly for forming adjacent bags from the tubular web wherein the forming assembly further includes a sealing member (305) for providing a seal across the web, which seal is commonly formed along oblique edges of the adjacent bags; at least one drive mechanism (150) for griping and drawing the packaging material through said at least one guide; a cutting device for cutting first and second bags drawn from the supply, wherein the first bags are each adjacent to respective second bags; a plurality of transport carriages (210, 220, 230, 240, 250, 260), said carriages including a gripping means (270) being arranged to grip and carry first and second bags; a plurality of filling devices (400, 450) associated with the transport carriages, said filling devices charging a flexible pocket of the bags with a viscous material; and at least one sealing device (500, 550) for sealing the charged pocket of the bags.

19 Claims, 31 Drawing Sheets

U.S. PATENT DOCUMENTS

| | | | | | |
|---|---|---|---|---|---|
| 3,448,915 | A | * | 6/1969 | Schwarzkopf | 383/37 |
| 4,113,169 | A | * | 9/1978 | Carlisle | 383/37 |
| 4,205,765 | A | * | 6/1980 | May | 222/107 |
| 4,279,608 | A | * | 7/1981 | Evers | 493/247 |
| 4,580,473 | A | * | 4/1986 | Seiden et al. | 83/23 |
| 4,634,006 | A | * | 1/1987 | Yanase | 383/204 |
| 4,658,569 | A | | 4/1987 | Hanagata | |
| 4,768,411 | A | | 9/1988 | Su | |
| 5,024,042 | A | * | 6/1991 | Meyer | 53/168 |
| 5,090,597 | A | * | 2/1992 | Johnson | 222/107 |
| 5,800,062 | A | * | 9/1998 | Tobolka | 383/104 |
| 5,845,463 | A | * | 12/1998 | Henaux | 53/450 |
| 5,974,730 | A | * | 11/1999 | Chien | 47/41.01 |
| 6,179,165 | B1 | * | 1/2001 | Knight et al. | 222/107 |
| 6,557,731 | B1 | * | 5/2003 | Lyon et al. | 222/94 |
| 2004/0011001 | A1 | * | 1/2004 | Hiramoto | 53/133.2 |
| 2005/0263014 | A1 | | 12/2005 | Ejeblad | |

FOREIGN PATENT DOCUMENTS

| | | |
|---|---|---|
| EP | 0025711 | 3/1981 |
| JP | 08-301226 | 11/1996 |
| JP | 2004-196346 | 7/2004 |
| WO | WO 97/10996 | 3/1997 |

* cited by examiner 25
38
39
43
49

39
38
43
49

11.2
39
38
43
49

METHOD AND APPARATUS FOR FORMING AND FILLING FLEXIBLE PACKAGING

CROSS-REFERENCE TO RELATED APPLICATIONS

This application is related to and claims the benefit of Australian Provisional Application No. 2004904579 filed by the present applicant on Aug. 13, 2004.

BACKGROUND OF THE INVENTION

1. Field of the Invention

The present invention relates to a method and apparatus for forming and filling sealed packaging with a flowable product. In particular, although not exclusively, the present invention relates to method and apparatus for forming and filling piping or decorating bags with a viscous comestible product such as pastry fillings and toppings.

2. Discussion of the Background Art

Traditionally piping bags and the like were made from textiles such as calico or nylon. Usually these fabrics were folded with the ragged ends then being salvaged together to form a flexible pocket. Generally, the flexible pocket is of a conical shape with a nozzle attachment being provided at the tip to allow for the extrusion of viscous product such as cream or dough.

Usually such fabric bags were washed out and reused, however some health concerns have been raised regarding this practice. This has led to an increase in the use of disposable piping bags in the bakery and catering industries, suitable formed from low cost, inert materials.

A simple form of disposable piping bag is one folded from a sheet of baking or grease proof paper. The sheet is simply cut into a rectangular shape and then cut diagonally to form two (2) right-angled triangles. To form a flexible pocket the top point (the point nearest the right angle) of the sheet is curled to meet the point of the right angle thus forming a conical vessel. The remaining point is the brought around the outside to overlap the cone, closing the point. When the simple piping bag is to be used, the filling is placed in the pocket and the end is cut to produce the desired sized piping opening. Piping bags made in this manner are typically sealed by twisting the ends of the bag closed. This type of seal produced is not completely airtight and allows small amounts of air to impinge onto the product inside the bag. The exposure of the product to air increases the risk of spoilage and in particular tainting. Furthermore producing bags in this manner is somewhat time consuming, and in today's competitive hospitality and food service industries, many chefs or bakers do not have the time to stop and fold a new piping bag every time they wish to utilise a particular filling.

A bag or pouch forming apparatus for small amounts of product is described in EP 25711, which apparatus is provided for shaping a sealed tube bottom into a flat bag bottom and delivering the shaped bag to a conveyor for filling in a separate operation. The apparatus includes a turret mounted for indexing movement about a fixed generally horizontal axis. The turret has a plurality of stations, each station having a mandrel arrangement for forming the bags. In particular the apparatus shapes a continuous web into a tubular form with the side edges of the web being arranged in face to face relation and then heat bonded together with the edges being in an upstanding position. Thereafter the tube is cut to the desired length and formed with a transverse bottom seal which extends substantially at right angles to the plane of the side seam.

In DE 3543275 there is described a process for the continuous production of conical bags from two webs of thermoplastic material overlying one another. The webs are held at their edges and advanced along a platen for cutting off of parallelogram sections which are subsequently welded together. There is no discussion of an integral bag filling operation.

A further example of a disposable piping bag is described in EP 757006 entitled "Piping bag containing a bakery product and method for manufacturing such piping bag". The specification describes a piping bag made from a plastic film material and containing a vicious product such as whipped cream. The bag is formed from a continuous web of plastic film, which is cut into a triangular sheet and folded to form a comet. The cornet then is sealed such the edges of the triangular sheet starting from the tip of the cornet forming an orifice, which is then filled with the desired product. The cornet is then sealed along its base to closing the orifice and encasing the product within the bag. The disposable bag may also be optionally fitted with an insert located adjacent the tip.

Mass-production of piping bags in this manner is inefficient and leads to a considerable amount of wastage of the plastic film. Furthermore, the machine described in EP 757006 is only capable of handling productions runs requiring one particular filling, producing multiple bags containing separate fillings either requires multiple machines or switching the product supply between production runs, which is both costly and time consuming.

The reference to any background or prior art in this specification is not, and should not be taken as an acknowledgement or any form of suggestion that the referenced prior art forms part of the common general knowledge in Australia or any other country.

SUMMARY OF THE INVENTION

Object of the Invention

Clearly, it would be advantageous if an apparatus and method for producing and filling packaging, particularly disposable pouches or piping bags, which reduces material wastage, improves the efficiency of the manufacturing process and, where required, integrates bag forming and filling procedures into a continuous operation and allows for the usage of multiple fillings in a single production run.

Disclosure of the Invention

According to one broad aspect of the invention there is provided an apparatus for forming and filling flexible bags with a viscous product, said apparatus including:

a support for a supply of a tubular web of flexible packaging material;

at least one guide for accepting from said supply a continuous feed of the tubular web of packaging material;

a bag forming assembly for forming adjacent bags from the tubular web wherein the forming assembly further includes a sealing member for providing a seal across the web, which seal is commonly formed along oblique edges of the adjacent bags;

at least one drive mechanism for griping and drawing the packaging material through said at least one guide;

a cutting device for cutting first and second bags drawn from the supply, wherein the first bags are each adjacent to respective second bags;

a plurality of transport carriages, said carriages including a gripping means being arranged to grip and carry first and second bags;

a plurality of filling devices associated with the transport carriages, said filling devices charging a flexible pocket of the bags with a viscous material; and at least one sealing device for sealing the charged pocket of the bags.

If required, at least each alternate transport carriage is adapted to invert each second bag cut from the supply Preferably the transport carriages are arranged for rotary motion, suitably being mounted on a common turntable. Alternatively the transport carriages may be arranged for linear motion, suitably including a first carriage and a second carriage arranged for linear motion on a common track. The rotary or linear motion is relative to the plurality of filling devices and said at least one sealing device.

According to another aspect of the invention there is provided a bag filing apparatus for filing bags with a viscous product, said apparatus including:

a support for a supply of packaging material including a plurality of bags, wherein adjacent bags in the supply are disposed in opposing relation to one another;

a separating device for separating bags drawn from the supply;

a plurality of filling devices at respective first filling station for filling bags with the viscous product;

a first transport means for carrying a first bag to the first filling station and presenting the first bag to the first filling device for filling;

a second filling device at a second filling station for filling bags with the viscous product;

a second transport means for carrying a second adjacent bag to the second filling station and presenting the second bag the second filling device for filling; and at least one sealing device for sealing said bags after filling.

Preferably the filling machine further includes a guide member, such as a feed chute, for guiding the web to a cutting means, and drive means for drawing the web from the supply. The drive means suitably comprises frictional rollers or a shuttle means.

Preferably the first and second filling devices each include a pump, such as a volumetric piston pump, and an outlet nozzle.

Suitably the cutting or separating means includes a movable cutting device or alternatively, an oblique cutting device and a lateral cutting device. Most preferably the oblique cutting device is of a hot wire type or of a heated bar type. The lateral cutting device may include a head having a blade mounted therein.

In preference, the first and second transport means each comprise a carriage mounted on tracks, suitably said tracks being common to the first and second carriages which carriages are arranged for reciprocating motion therealong.

Alternatively, the first and second transport means may each comprise a carriage mounted on a turntable, which turntable is arranged for rotary motion.

Each carriage suitably includes clamps for gripping a bag, and a bag opening device, such as pneumatic suction cups for opening a mouth of the bag for presentation to a nozzle of the filling device.

Alternatively the bag opening device may be provided as a cradle assembly which suitably includes a clamping plate and gripping clamps for engaging a portion of the bag. The clamps may be laterally displaced to cause at least on wall portion of the bag to buckle and thereby create filling mouth. Suitably the surfaces of the clamping plate and gripping clamps are coated with a non-slip material such as polyurethane or other such suitable polymers. Preferably the cradle assembly is mounted to the frame of the filling apparatus. Alternatively the cradle assembly may be mounted on the bag carriage.

The second carriage further includes a bag inversion sub-assembly wherein, in one form, the clamps and the bag opening device are rotatably mounted relative to the carriage to allow the bags to be inverted or reversed for presentation to a nozzle of the second filling device. Suitably the bag inversion sub-assembly includes followers provided for engagement with an elongate surface having an arcuate portion, which portion is arranged to invert the sub-assembly during travel of the second carriage from the cutting station to the second filling station.

The filling machine may further include a conveyor onto which the filled bags are deposited after sealing.

Preferably, the filling machine also includes a printer for providing, such as by printing or transposing, images or indicia onto each of the plurality of bags provided in the supply.

Each viscous product supply for the first and second filling devices may contain the same comestible product or may contain different products, for example one may contain whipped cream while the other contains jam or other such fillings or toppings.

Preferably the sealing device includes a heat sealing heat or a welding means capable of providing an airtight seal for the mouth of each bag after filling.

According to further aspect of the present invention there is provided a method of producing and filling bags with a viscous product, said method including the steps of:

providing a plurality of bags from a supply of flexible packaging material, wherein successive first and second adjacent bags in the supply are disposed in opposing relation to one another;

gripping and cutting a first bag obtained from the supply;

carrying the first bag from the supply to a first filling station;

opening and filling said first bag with the viscous product at the first filling station;

gripping and cutting a second bag obtained from the supply;

carrying the second bag from the supply to a second filling station;

sealing and releasing the filled first bag before moving to the supply of bags for a further first bag;

opening and filling the second bag with the viscous product at the second filling station; and sealing and releasing the second filled bag, before moving to the supply of bags for a further second bag.

Suitably the step of providing a plurality of bags includes provision of a supply in the form of a series of pre-formed bags disposed in a continuous web or dispensed individually from a magazine arrangement. Most preferably single pre-formed bags may be fed into the grippers on bag carriages at either end of the apparatus.

If required, the step of providing a plurality of bags includes the step of forming the bags from a supply of a tubular web, suitably formed from flexible plastics film.

The forming step in this instance includes a sealing step whereby the continuous supply is divided into adjacent bags, each sharing a common lateral seal along opposing oblique edges. The bags may be cut from the supply subsequent to sealing. If required, the step of carrying the second bag may be preceded or followed by inverting said second bag.

The carrying steps suitably involve rotary motion, provided by a common turntable upon which bag carriages for respective first and second bags are mounted.

Alternatively, the carrying steps involve linear motion, provided by first and second transport means for respective first and second bags. The first transport means and the second transport means move independently on a common track, suitably by reciprocating therealong.

Suitably the method may include the additional step of printing images or indicia on the plurality of bags provided on the supply, preferably prior to cutting bags from the supply.

BRIEF DETAILS OF THE DRAWINGS

In order that this invention may be more readily understood and put into practical effect, reference will now be made to the accompanying drawings which illustrate preferred embodiments of the invention, and wherein.

Figures 4A, 4B, 4C:
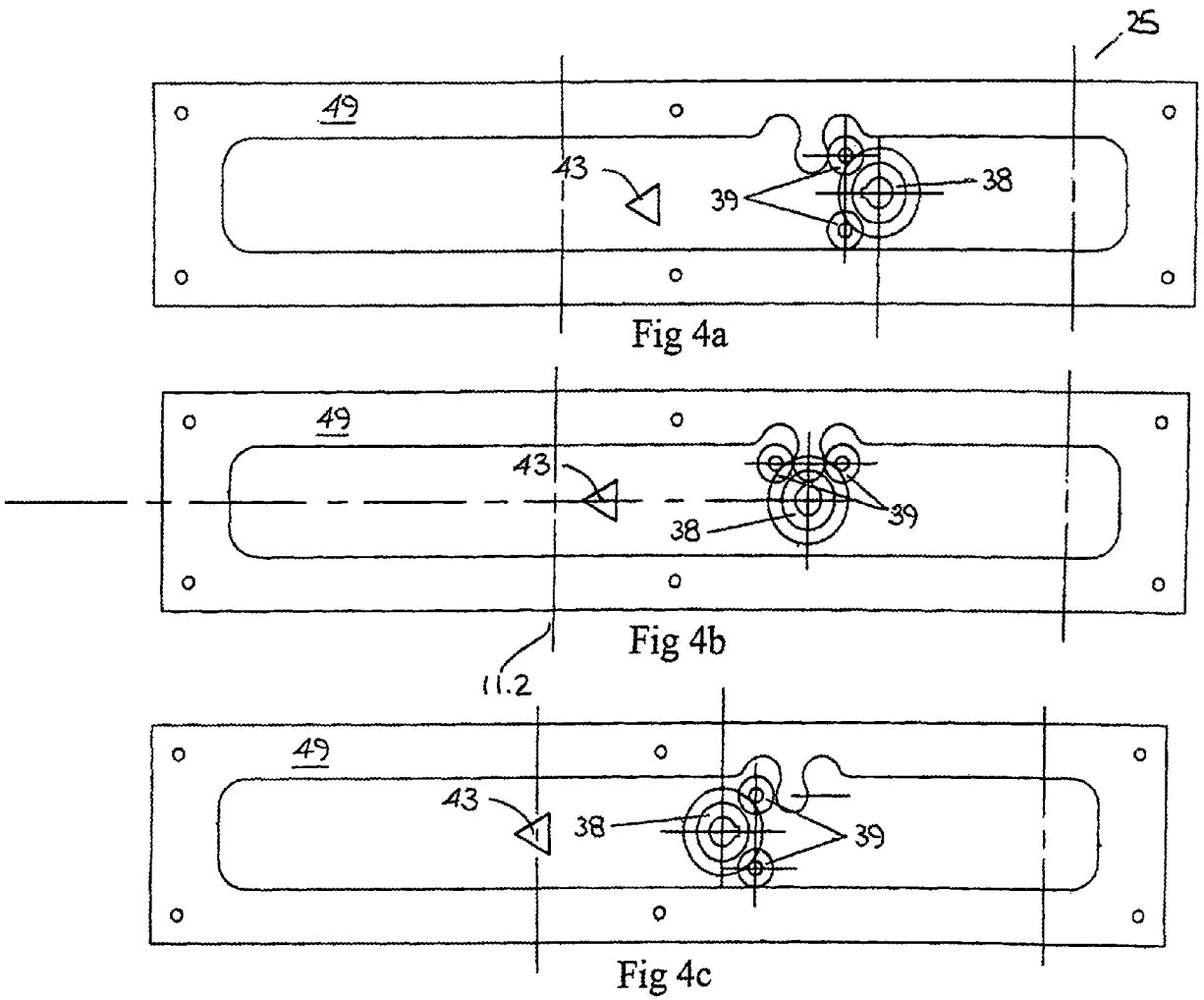
Figure 5:
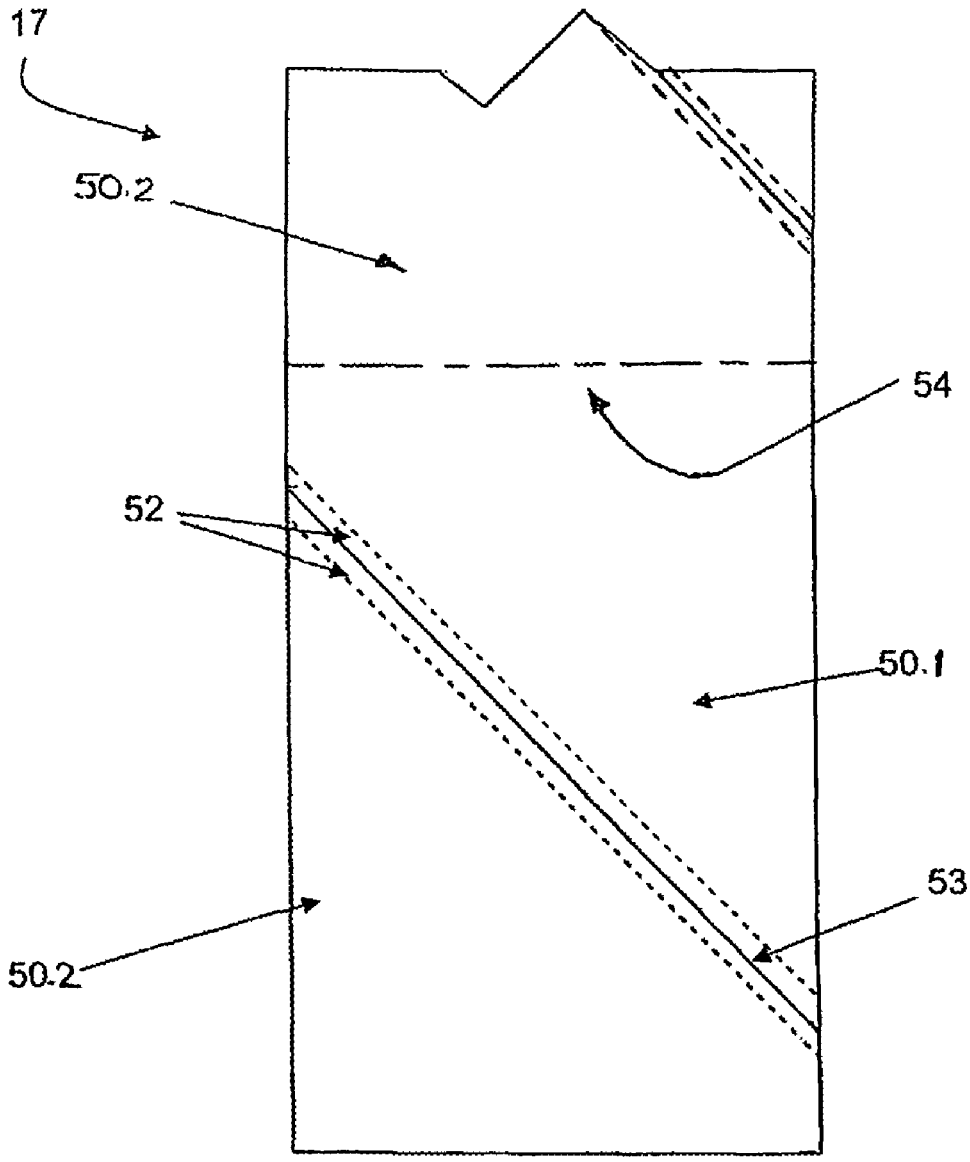
Figure 6:
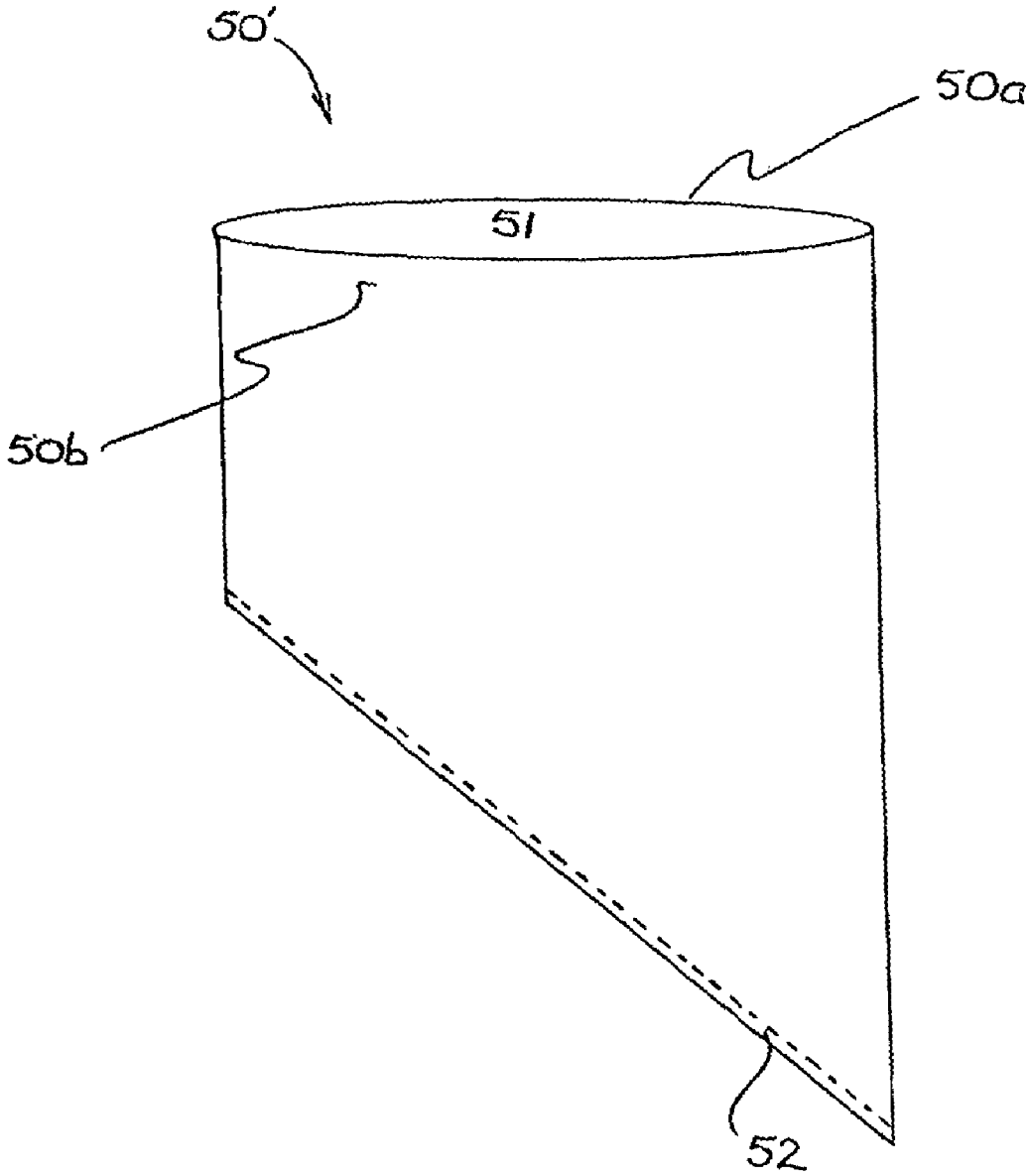
Figure 7:
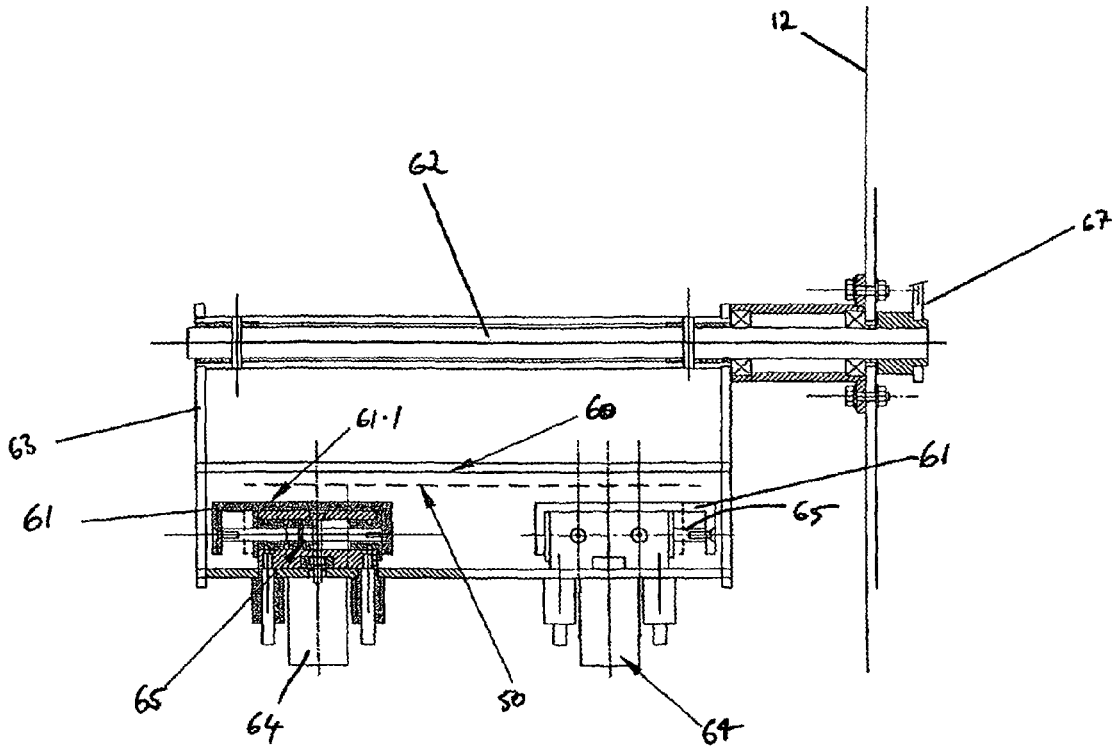
Figure 8:
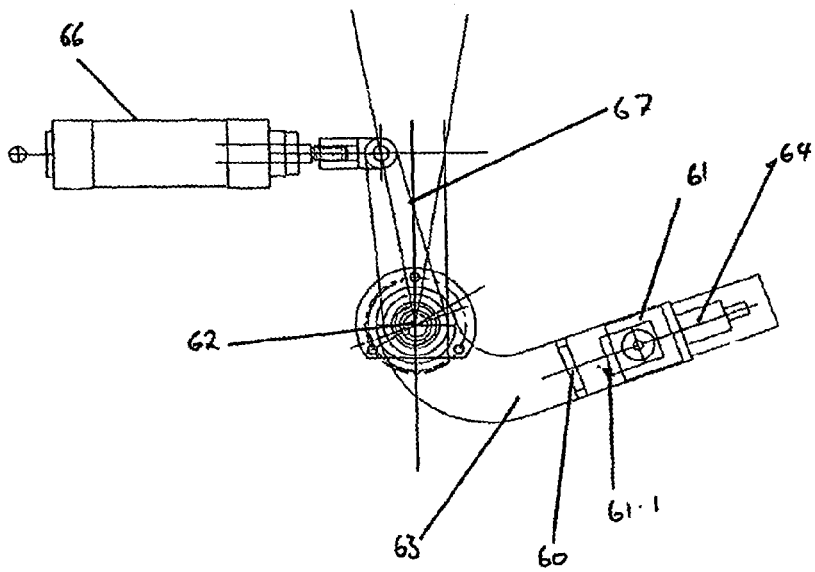
Figure 10A:
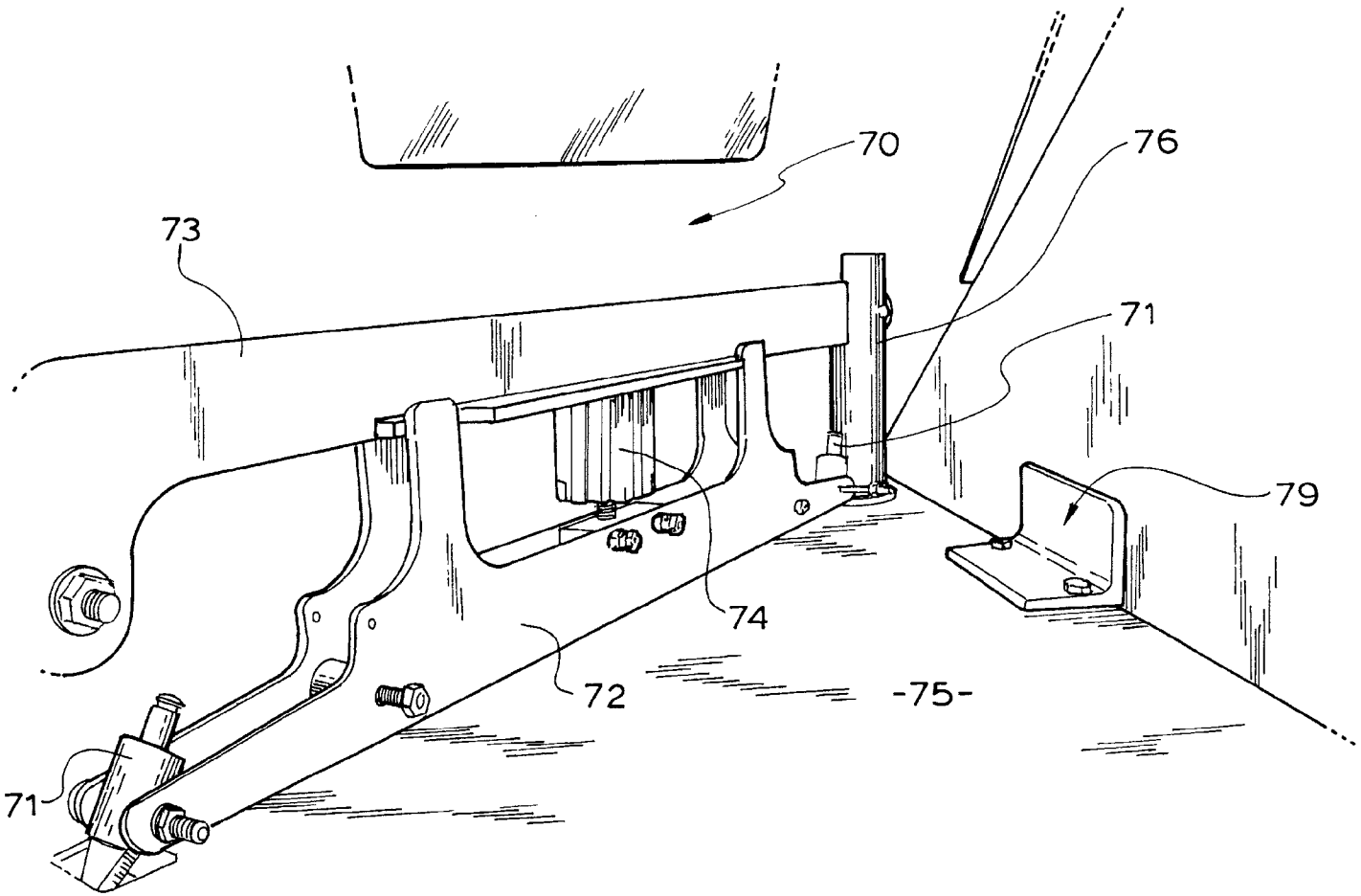
Figure 10B:
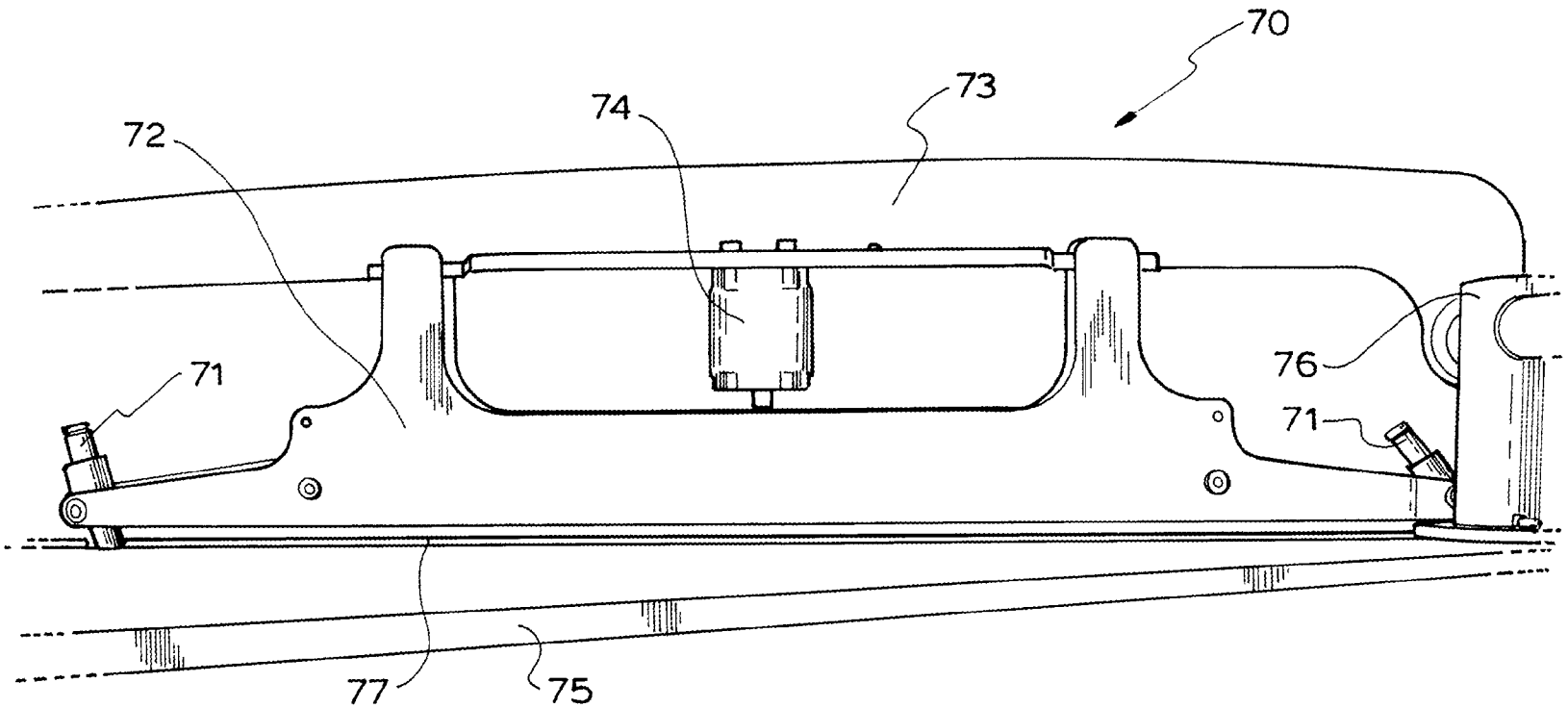
Figure 11:
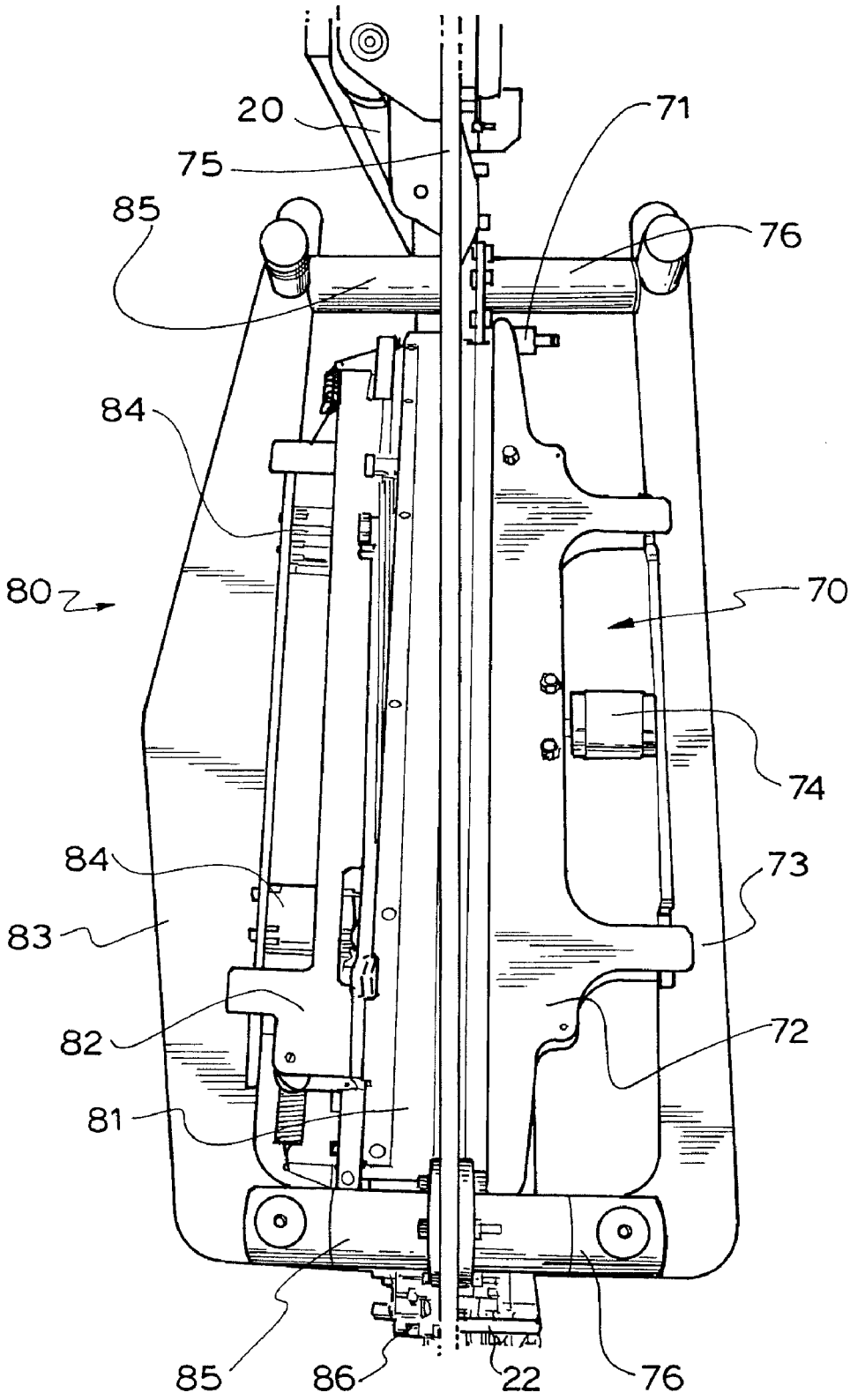
Figure 12:
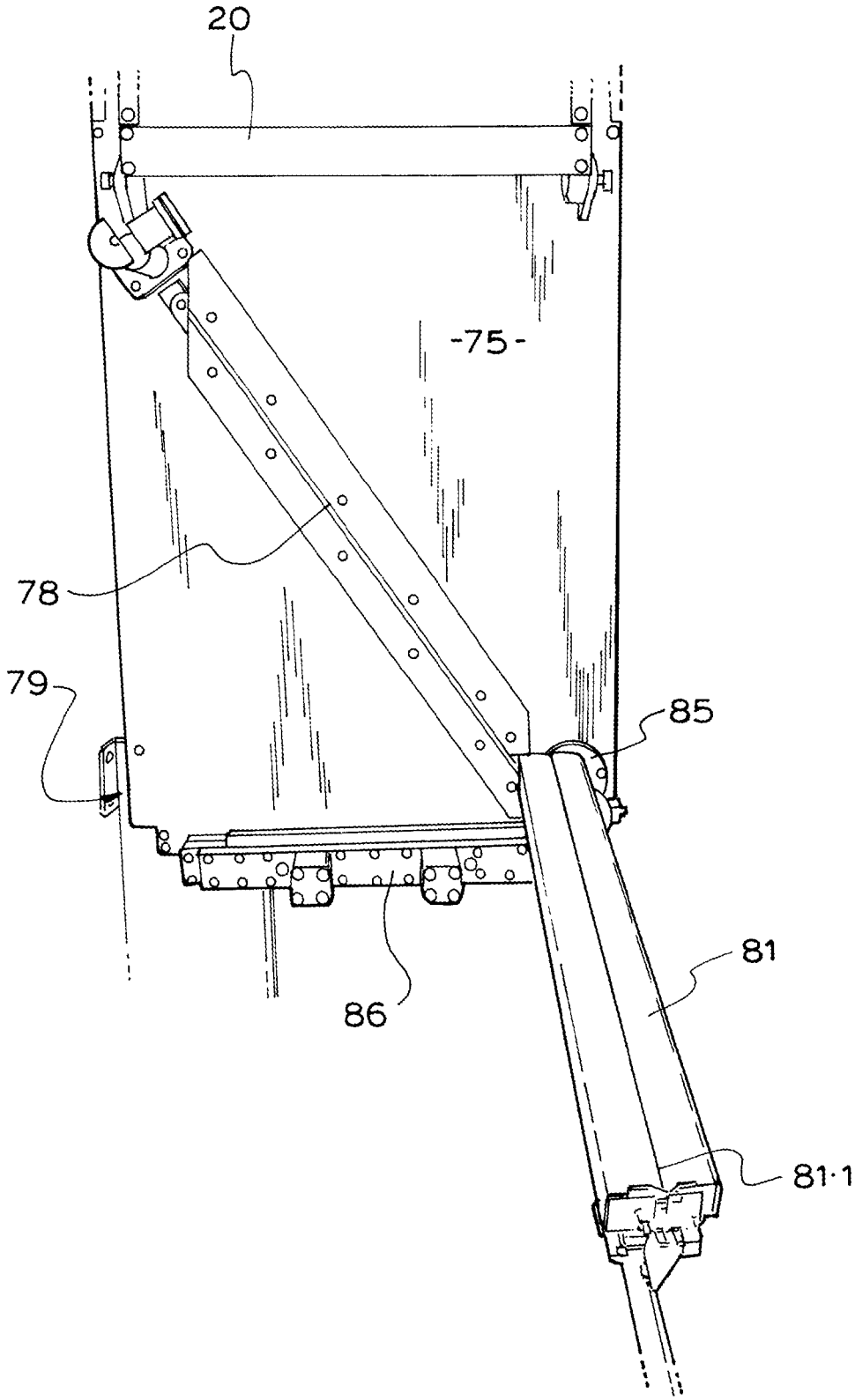
Figure 13:
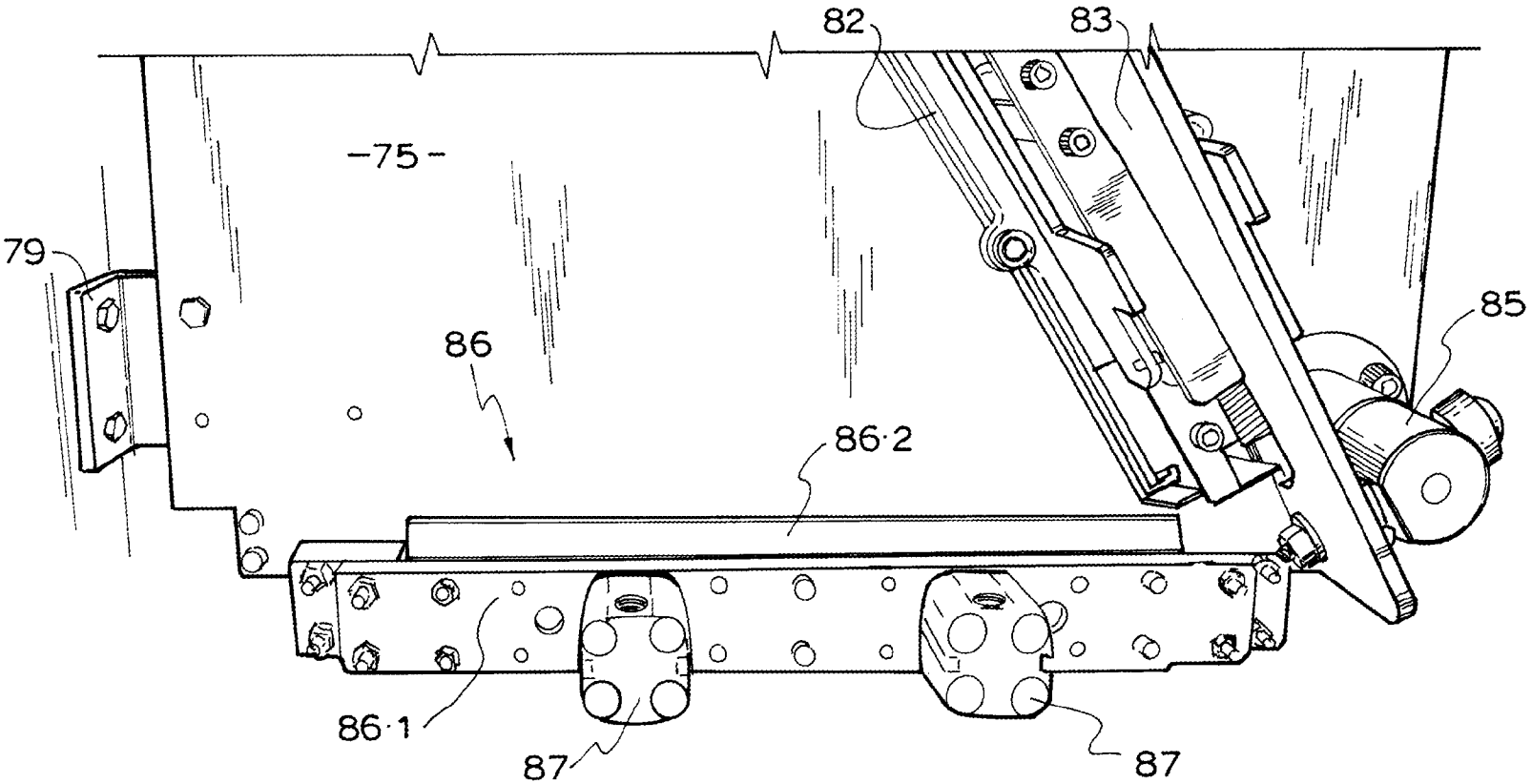
Figure 14:
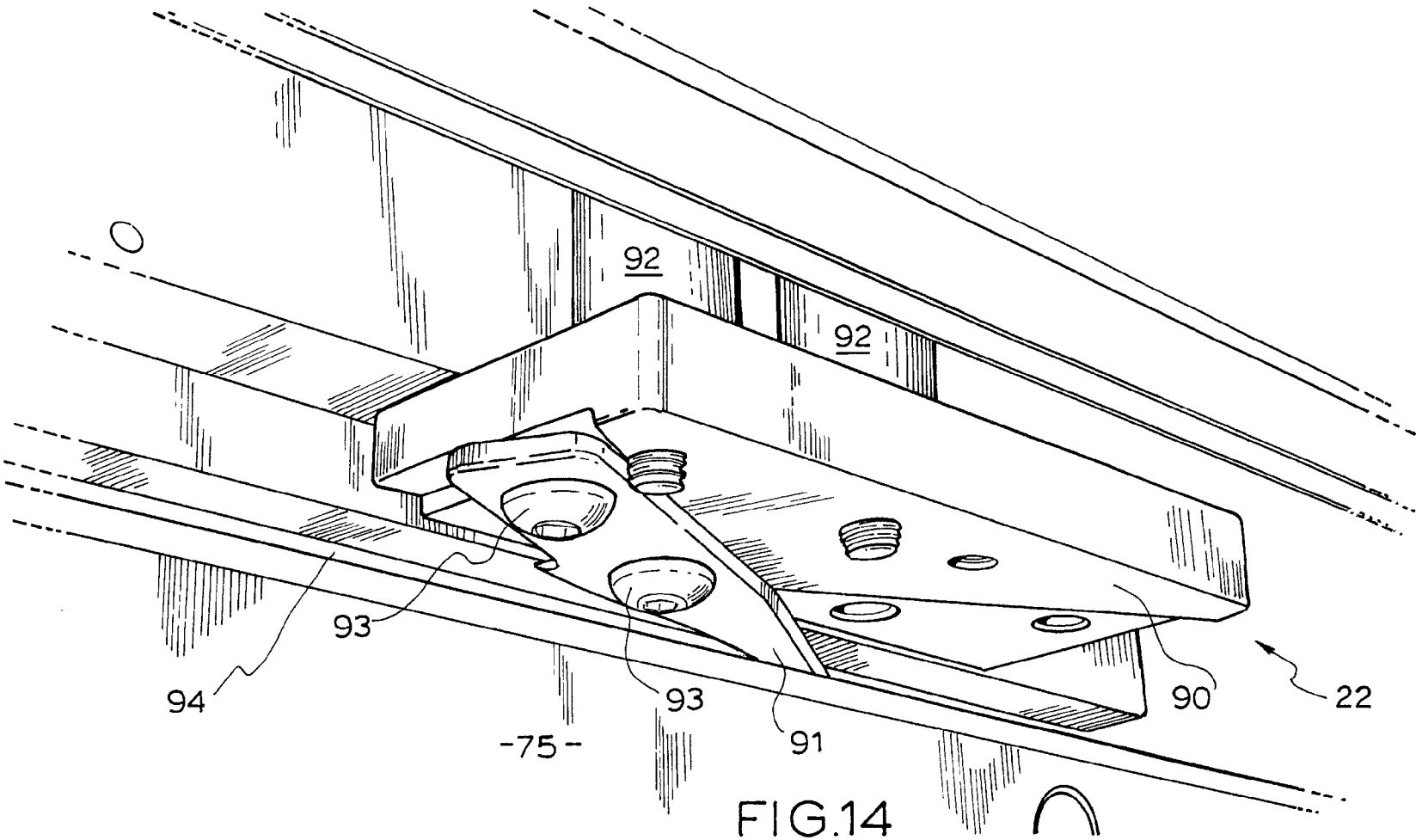
Figure 15:
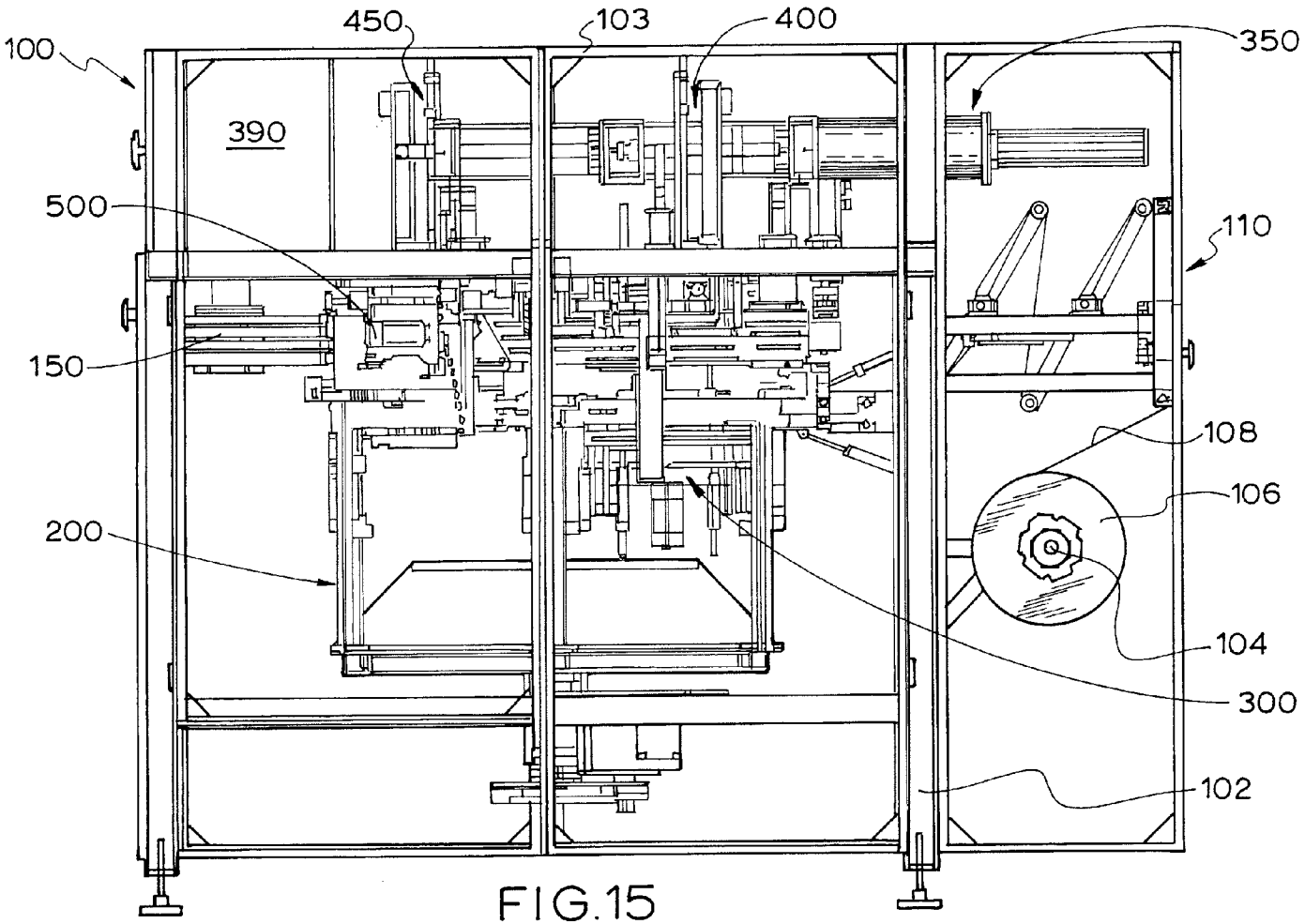
Figure 16:
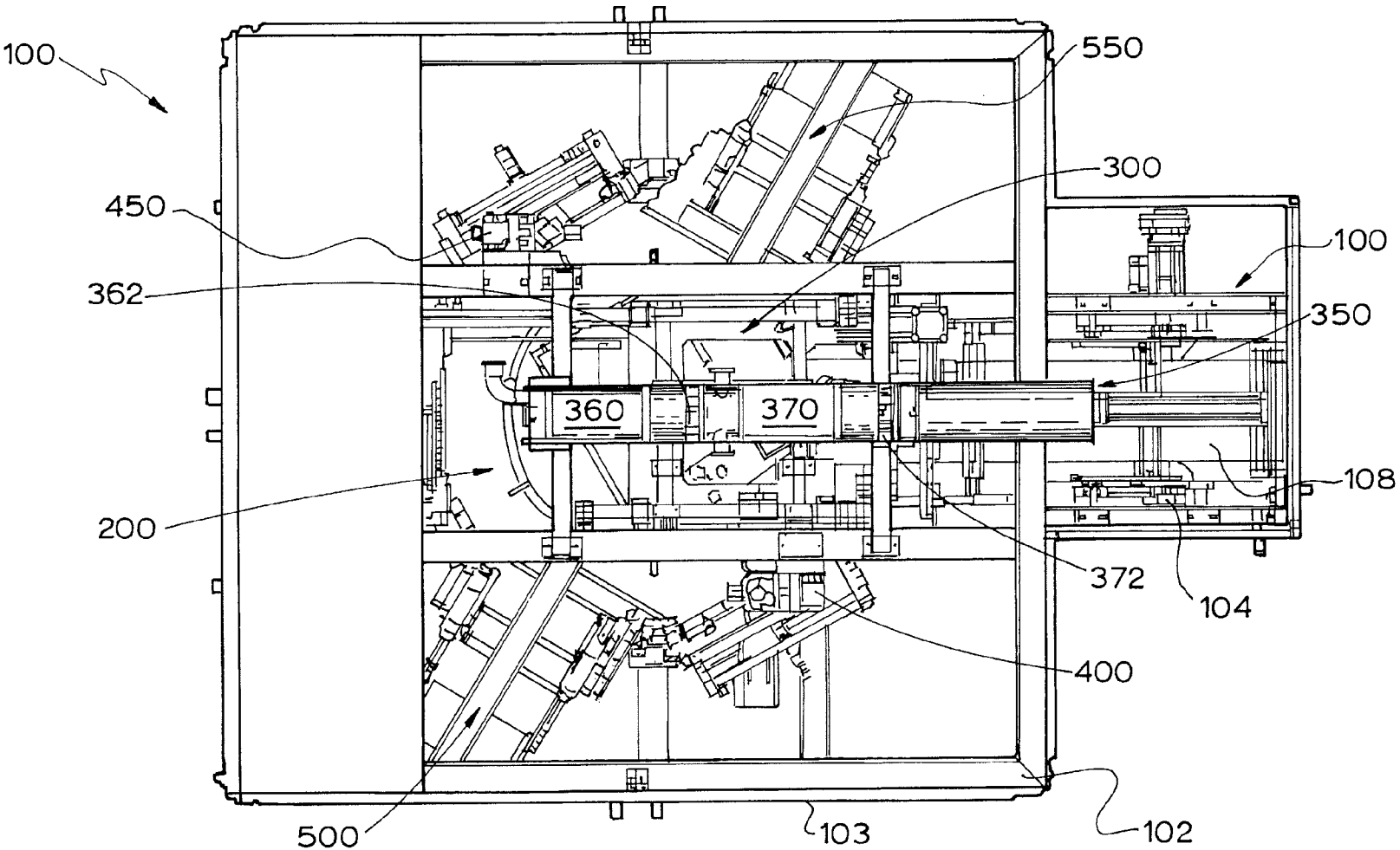
Figure 17:
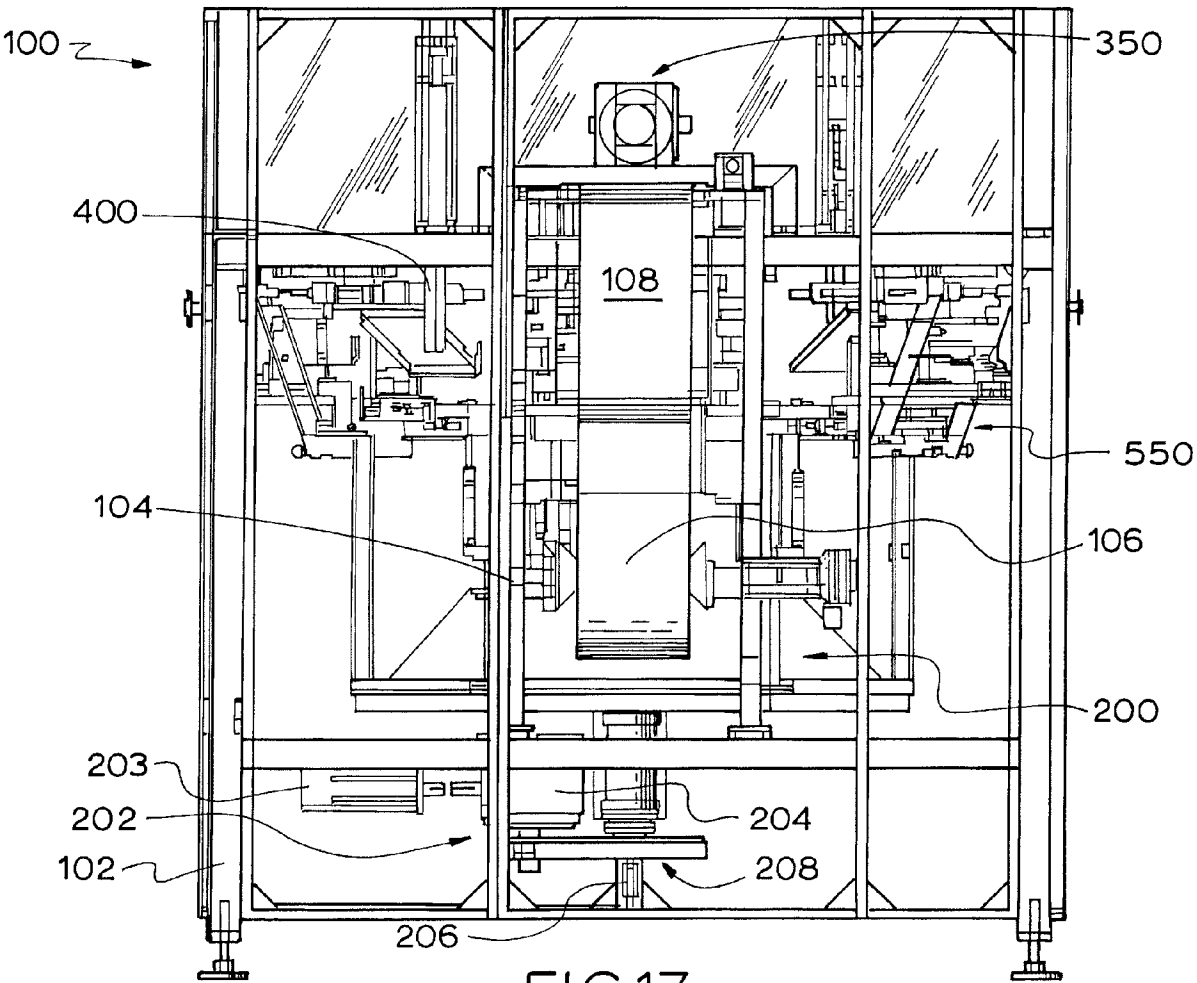
Figure 18:
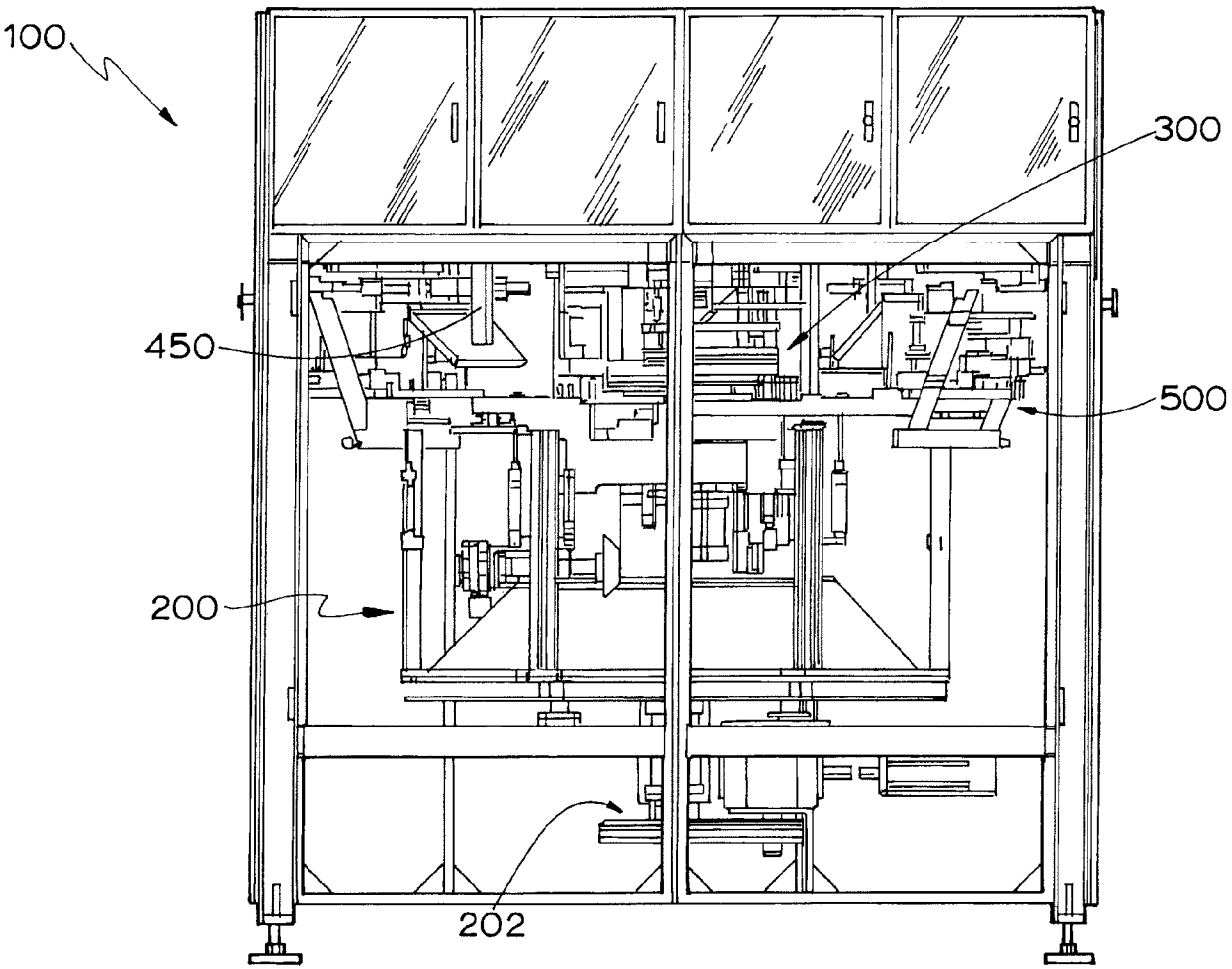
Figure 19:
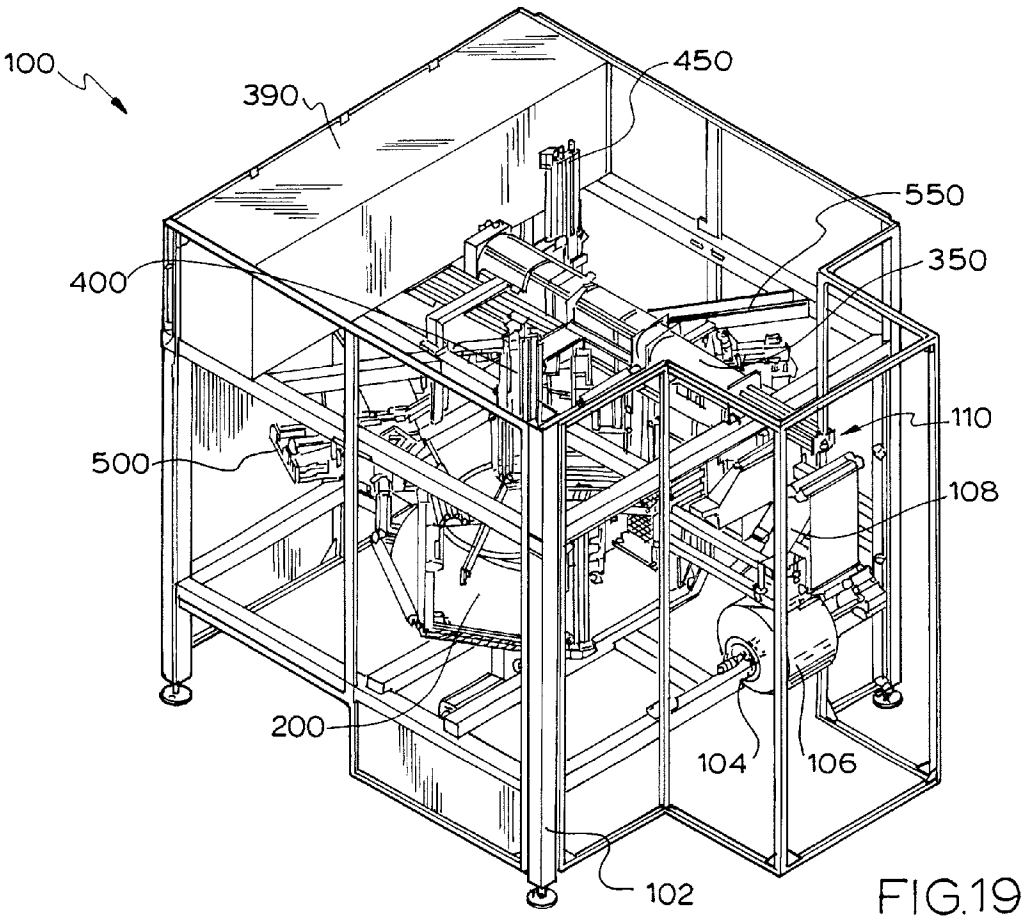
Figure 20A:
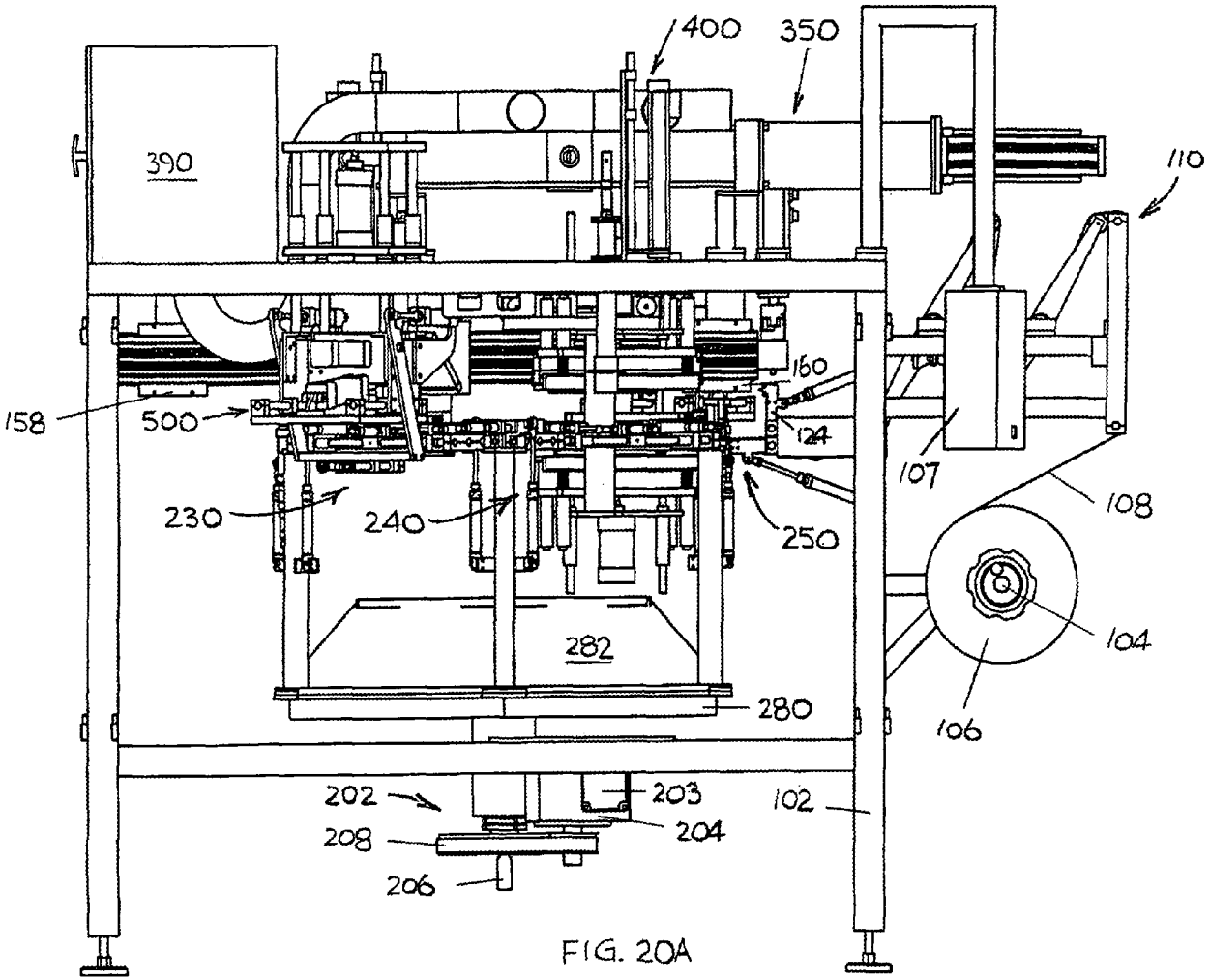
Figure 20B:
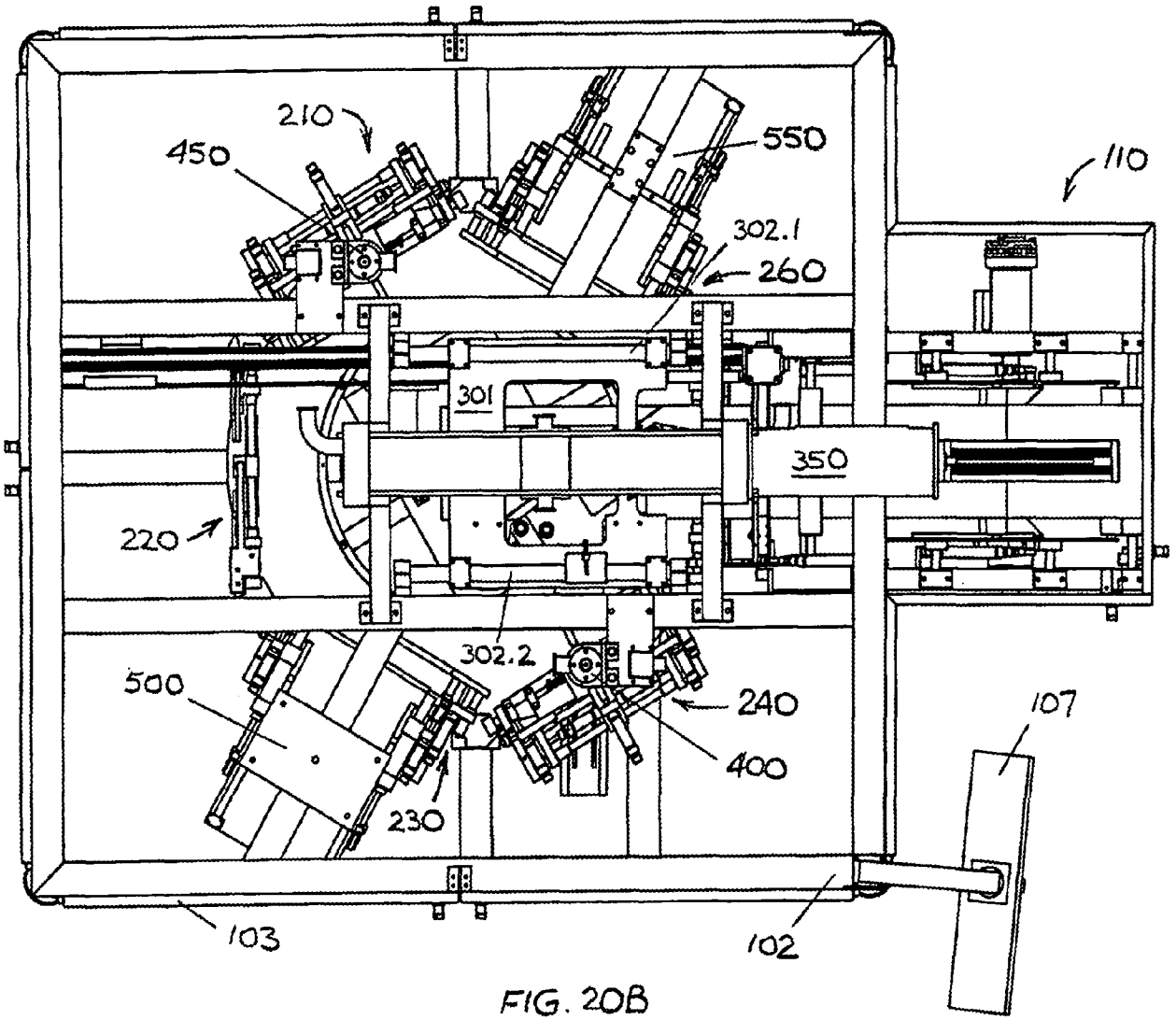
Figure 21:
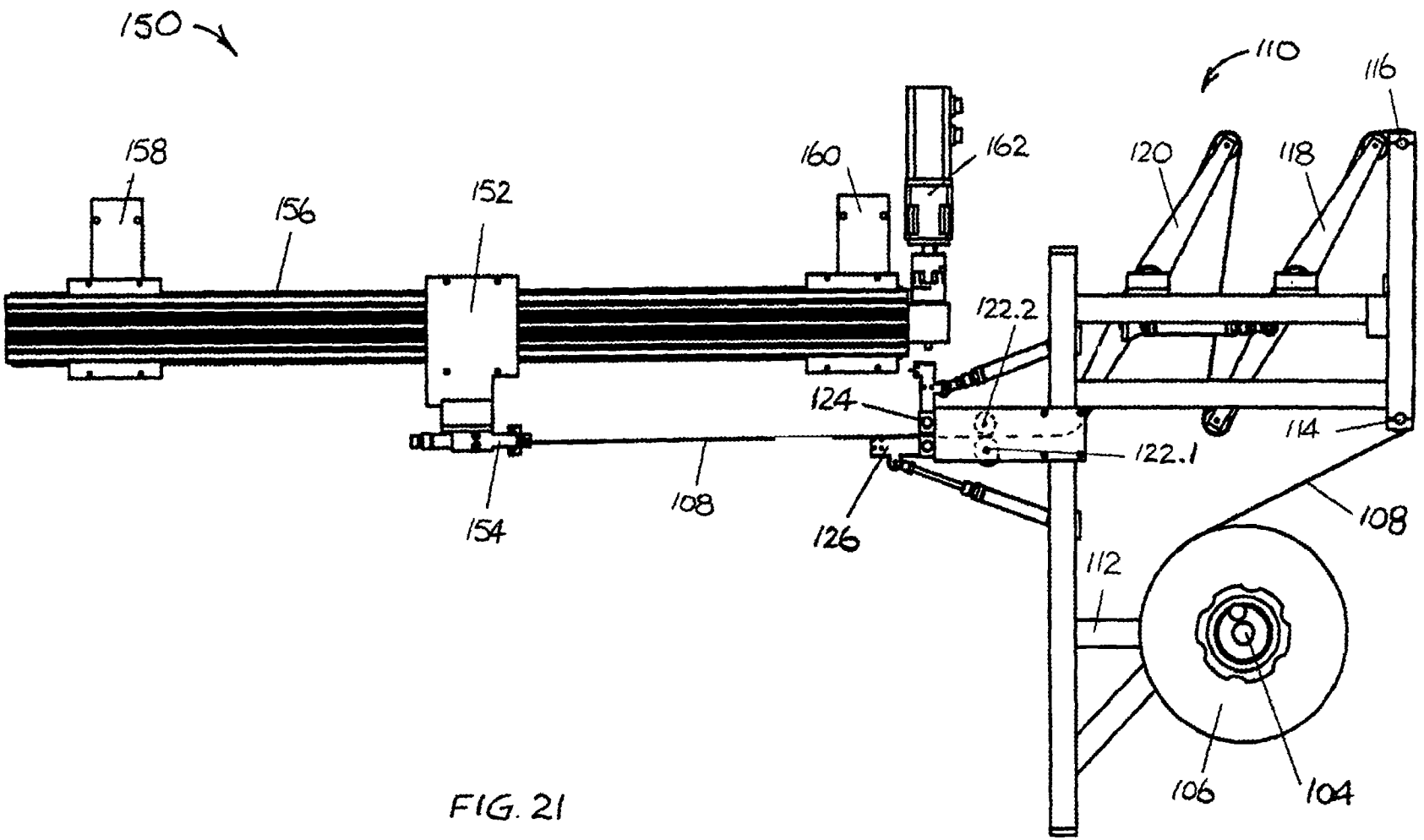
Figure 22:
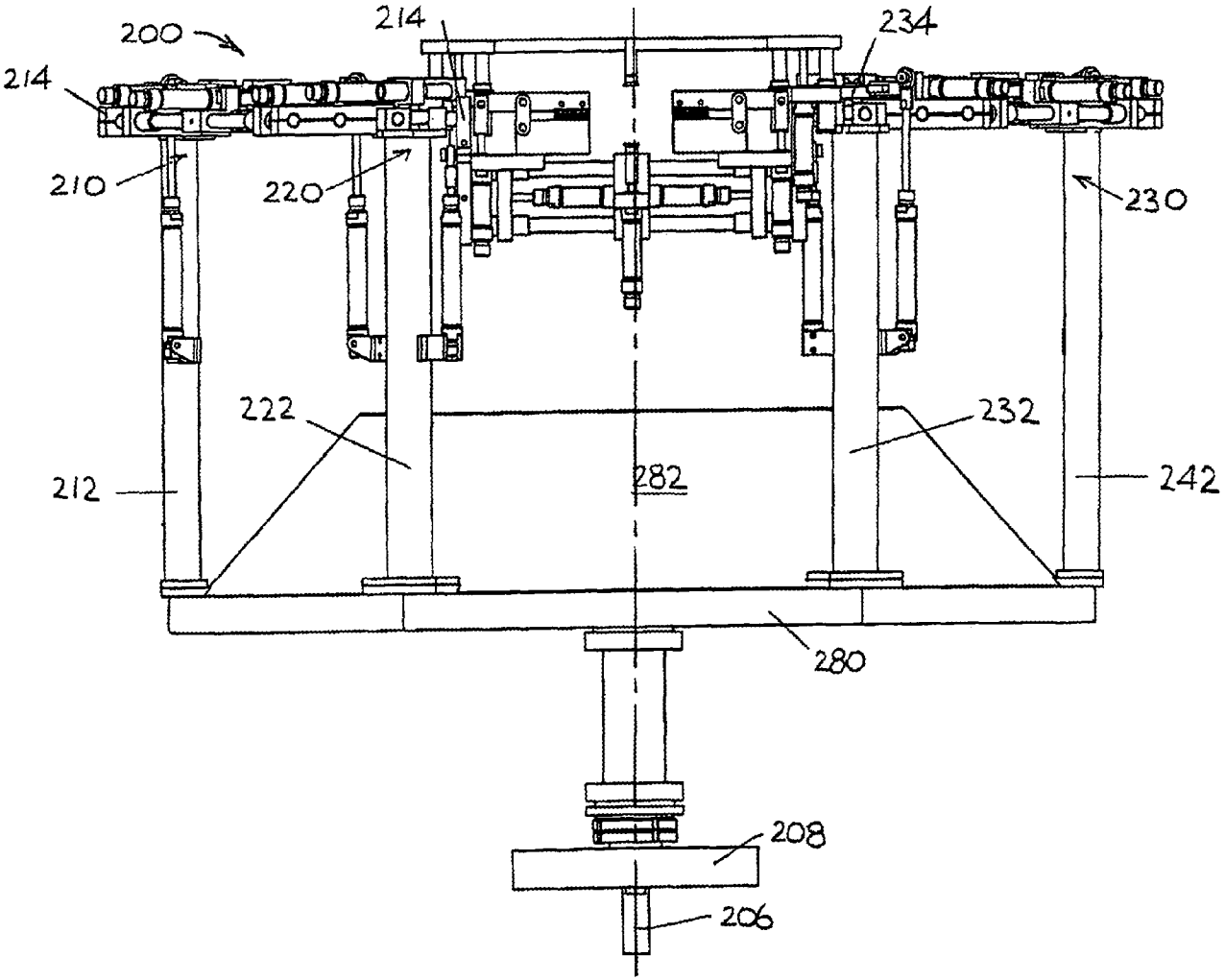
Figure 23:
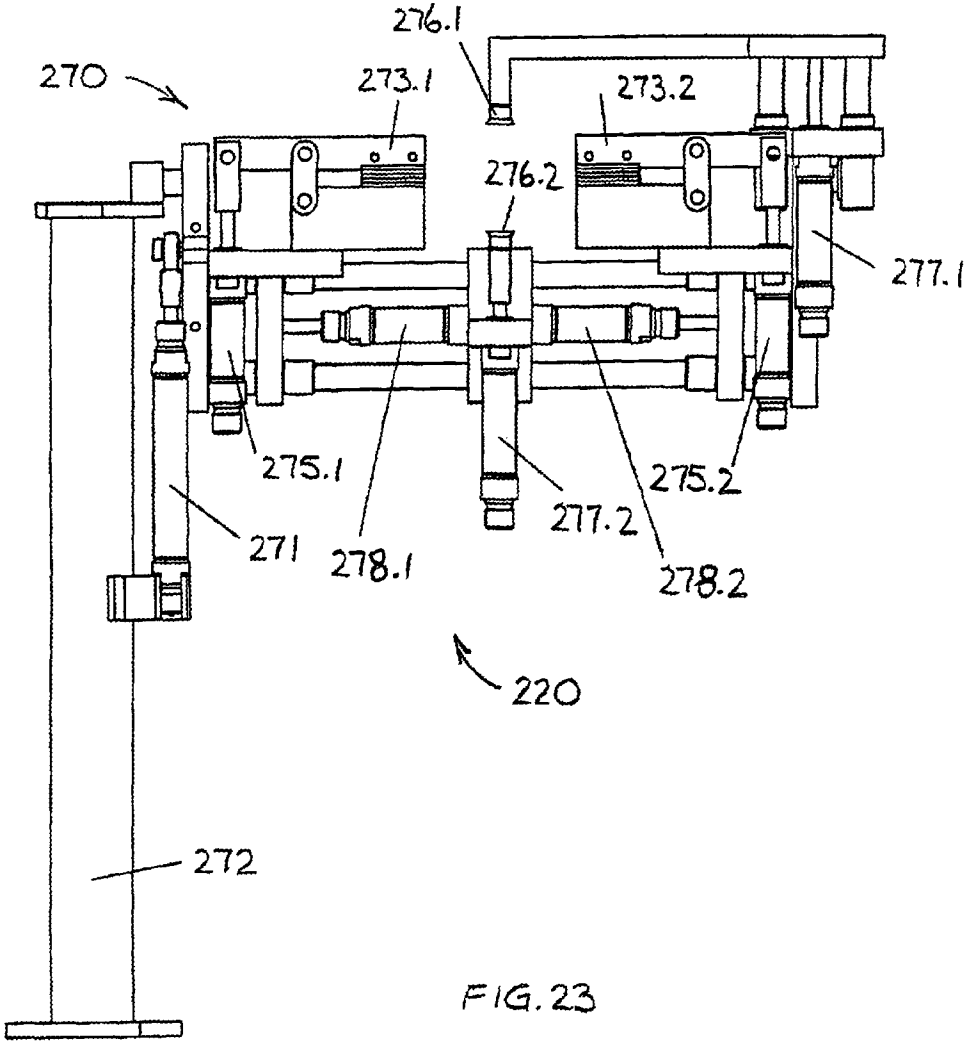
Figure 24:
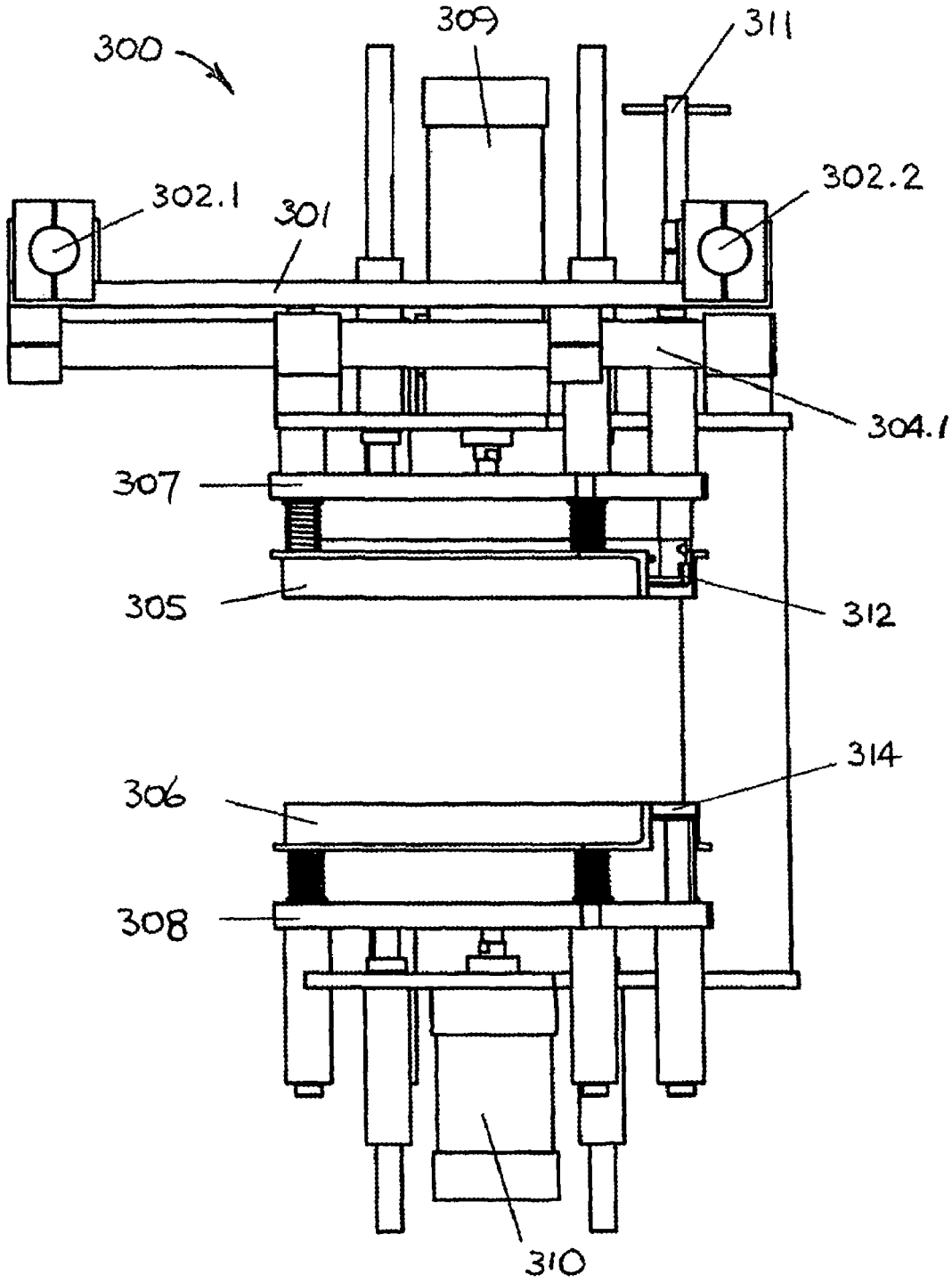
Figure 25:
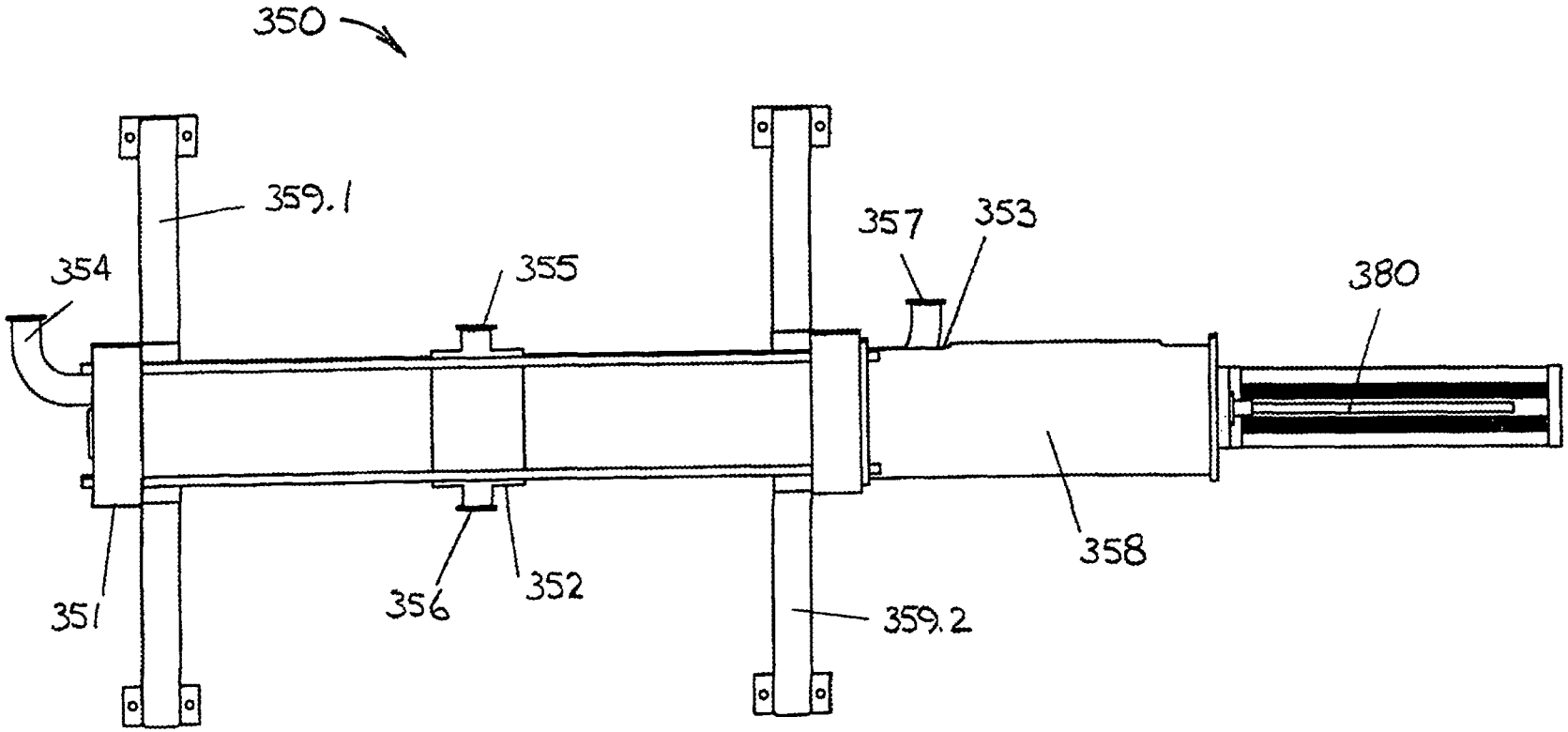
Figure 26:
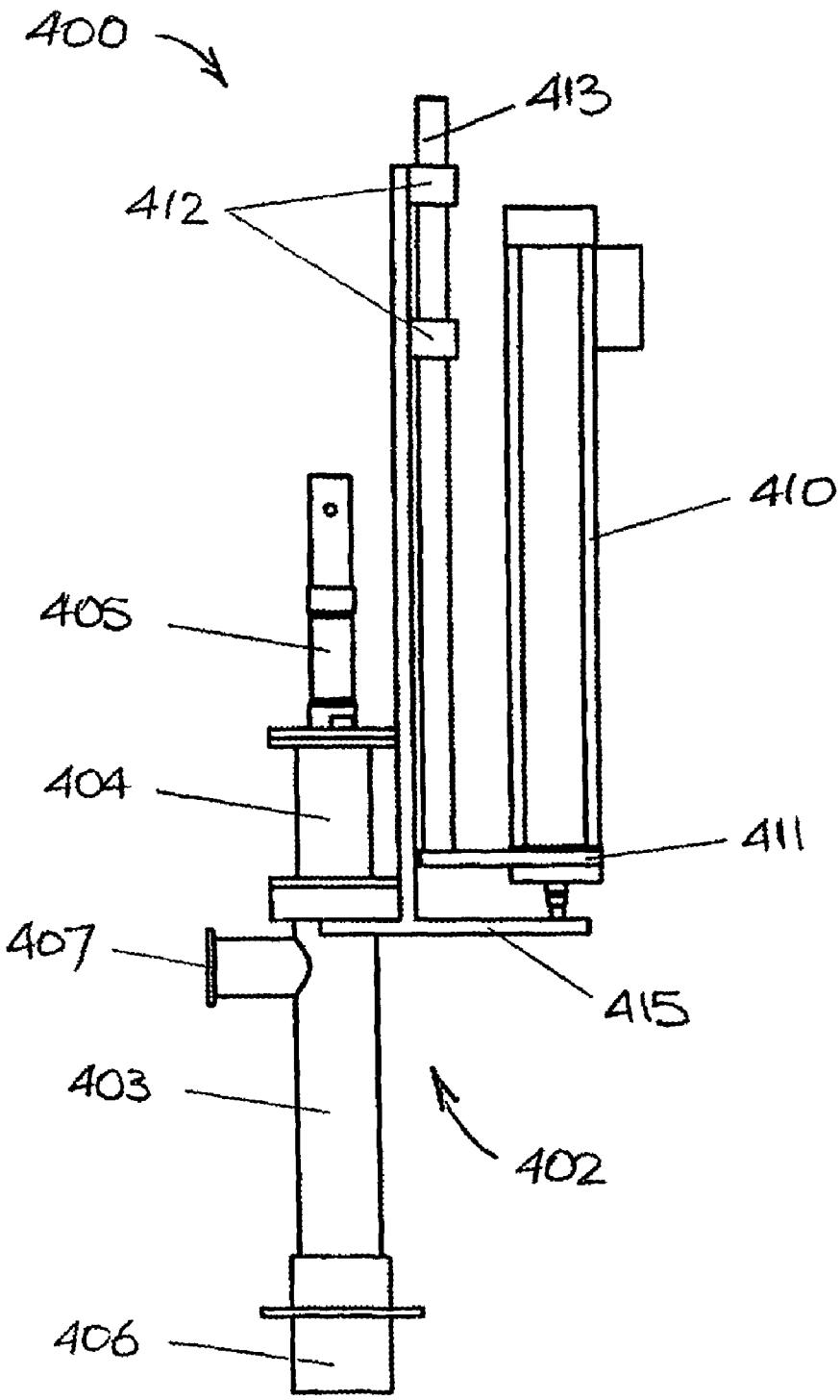
Figure 27:
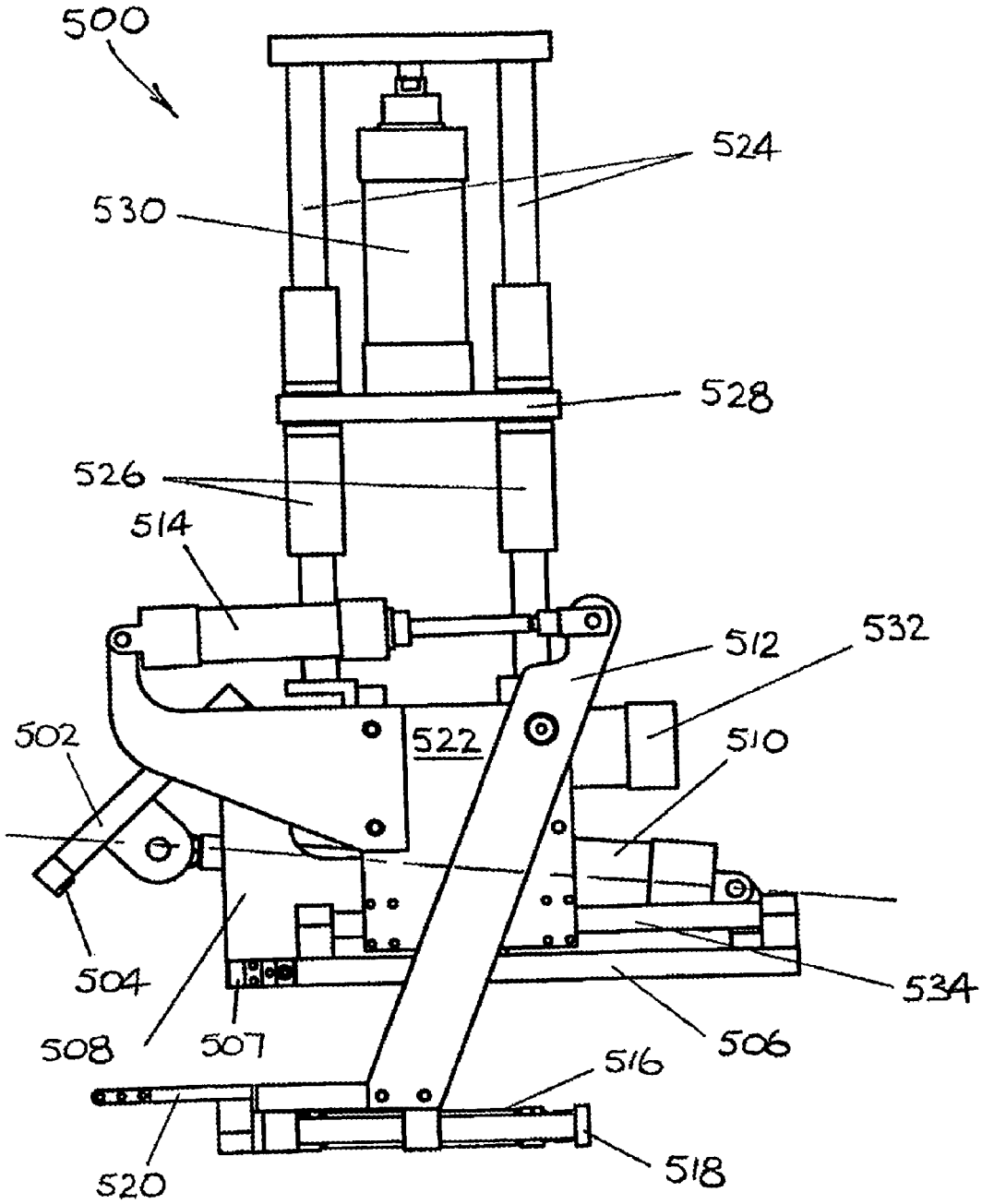

FIGS. 4A, 4B and 4C provide detailed views of a turn-over mechanism sequence for the bag carriage of one embodiment of the present invention;

FIG. 5 is a view of the bags disposed in opposing relation within the supply of packaging material;

FIG. 6 is the detailed view of a bag cut from the supply prior to filling;

FIG. 7 is a top plan view of a further embodiment of the bag opening mechanism;

FIG. 8 is a side elevatorial view of a further mounting arrangement for the bag opening mechanism of FIG. 7;

FIGS. 9A, 9B, 9C and 9D are views of the bag opening mechanism of a further embodiment of the bag filling apparatus in operation;

FIGS. 10A and 10B are views of an oblique cutting device of one embodiment of the invention;

FIG. 11 is a side view of the forming portion of one embodiment of the invention;

FIG. 12 details the forming portion of FIG. 11 in partial assembly;

FIG. 13 is a front view of the film clamping mechanism of the forming portion of FIG. 11;

FIG. 14 is a detailed view of the lateral cutting device of the forming portion of FIG. 11;

FIG. 15 is a front view of a bag forming and filling apparatus of a second embodiment of the present invention;

FIG. 16 is a top plan view of the bag forming and filling apparatus of the second embodiment;

FIG. 17 is a right side view of the bag forming and filling apparatus of the second embodiment;

FIG. 18 is a left side view of the bag forming and filling apparatus of the second embodiment;

FIG. 19 is a top perspective view of the bag forming and filling apparatus of the second embodiment;

FIGS. 20A and 20B are front and top plan views of the bag forming and filling apparatus of the second embodiment excluding the outer enclosure or cabinet;

FIG. 21 is a front view of the film or bag supply in-feed assembly from the second embodiment;

FIG. 22 is an end view of a turntable assembly from the second embodiment;

FIG. 23 is a front view of one of a plurality of bag gripping carriages of the turntable assembly of FIG. 22;

FIG. 24 is a left end view of an oblique film welding and cutting assembly from the second embodiment;

FIG. 25 is a top plan view of the pump assembly from the second embodiment;

FIG. 26 is a front view of a foot valve assembly at a filling station, which valve is associated with the pump assembly of FIG. 23; and FIG. 27 is a front view of a bag seal and lift assembly of a sealing station from the second embodiment.

DESCRIPTION OF EMBODIMENTS OF THE INVENTION

Figure 1:
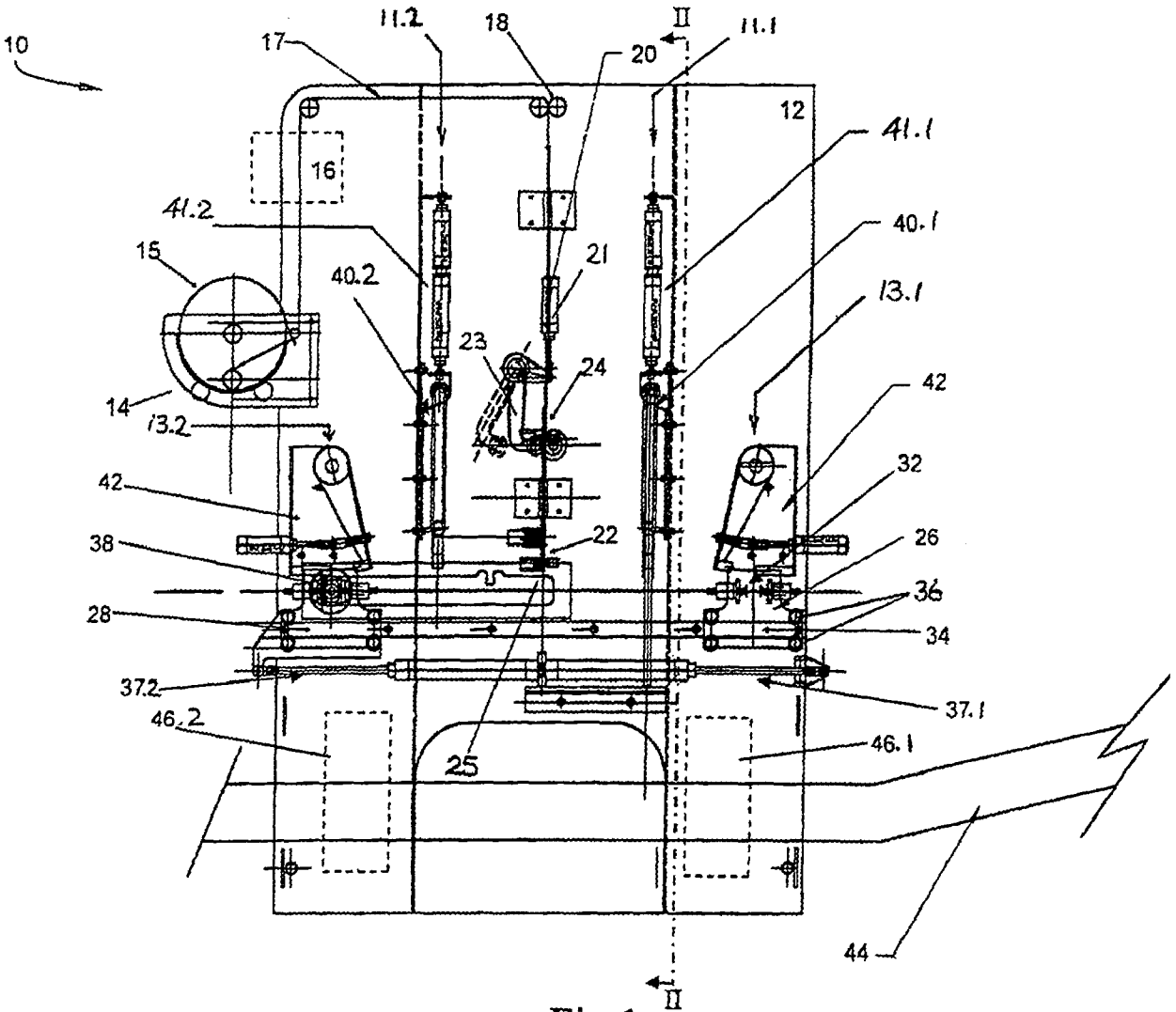
FIG. 1 is a schematic front elevation of a bag filling apparatus of a first embodiment of the present invention.

With reference to FIG. 1, there is illustrated a bag filling apparatus 10 of one embodiment of the present invention, which embodiment includes reciprocating bag carriages 26, 28. Packaging material in the form of a plastics film is supplied on film feed roller 15 and held by a support 14, which support is mounted on frame 12. The plastics film of packaging material is flexible and includes preformed bags, wherein adjacent bags in the supply are disposed in opposing relation to one another (see FIG. 5). The roller and support provide a controlled release of the packaging material in a continuous film 17. The packaging material is drawn between a set of film support rollers 18 through feed chute 20 and film cutters 22 via a movable pinch roller 23 and a cooperating fixed drive roller 24. A fluid actuator 21 is provided to urge the movable pinch roller 23 against the drive roller 24.

A printer 16 may optionally be mounted on to the frame 12 for printing or transposing indicia and images onto the preformed bags included in the packaging material. The indicia and images may range from company logos and the like identifying the supplier, the nature of the product, and a list of ingredients of the product to be contained within the finished bag. Preferably, the printer is mounted between the film feed roller 15 and the support rollers 18.

The bag filling apparatus 10 of the embodiment further includes two carriages 26, 28 for transporting bags 50 separated from the supply of packing film to respective filling stations 11.1, 11.2 and sealing 13.1, 13.2 stations. The carriages each include rollers 34 which engage with a common track arrangement 36. This arrangement allows a first actuator 37.1 to move the first carriage 26 laterally between the exit 25 of the film supply and the first sealing station 13.1 via the first filling station 11.1. Similarly, a second actuator 37.2 coupled to the second carriage 28, moves this carriage between the film exit 25 and the second sealing station 11.2 via the second filling station 13.2.

The pinch and drive rollers 23, 24, feed chute 20 and film roller 15 act in conjunction with clamps 30 provided on respective carriages 26 and 28 to keep the packaging film 17 under constant tension. When each carriage is located at the film supply exit 25, the clamps 30 grip a free end of the film and pull it taut, a separating device including film cutters 22 then excise one of the performed bags 50 from the supply. Once the bags 50.1 and 50.2 are separated from the packaging material by the film cutters 22, they are then alternatively transported to their respective first and second filling stations 11.1, 11.2 via one of the two (2) carriages 26 and 28.

The first carriage 26 (shown on the right-hand side of FIG. 1) receives and grips a first bag via a set of clamps (not shown). The bag 50.1, as accepted by the first carriage 26 is already disposed in an upright position as it exits the supply. When the carriage 26 transports the bag to the first filling station 11.1, this upright bag position allows the first filling nozzle 40.1 to charge a flexible pocket therein. To further aid the filling operation, the carriage 26 is fitted a bag opening device in the form of a set of vacuum cups 32, which engage the outer surface of opposing wall portions of the bag 50.1.

The cups 32 then retract drawing back the opposing sides of the bag to open the flexible pocket to provide a filling mouth. Once the pocket is opened and the filling mouth of the bag 50.1 positioned below the filling nozzle 40.1, by extending carriage actuator 37.1. The nozzle of the filling device is mounted on a two stage fluid actuator 41.1 which extends the nozzle 40.1 into the mouth of the bag. The bag 50.1 is then charged with a vicious material from a first reservoir 46.1 which is coupled to the nozzle by a valve and piston pump arrangement.

On completion of the filling step, the first carriage 26 is then positioned with the filled bag at the first sealing station 13.1 via further extension of the carriage actuator 37.1. Sealing heads 42.1 are then brought into engagement with the filling mouth of the bag to produce an airtight seal. The carriage 26 may then release the filled sealed bag 50.1 onto a conveyor 44 which travels under the sealing station, which suitably deposits the filled bags for packing. The conveyor 44 is suitably of a variable speed type.

Figure 2:
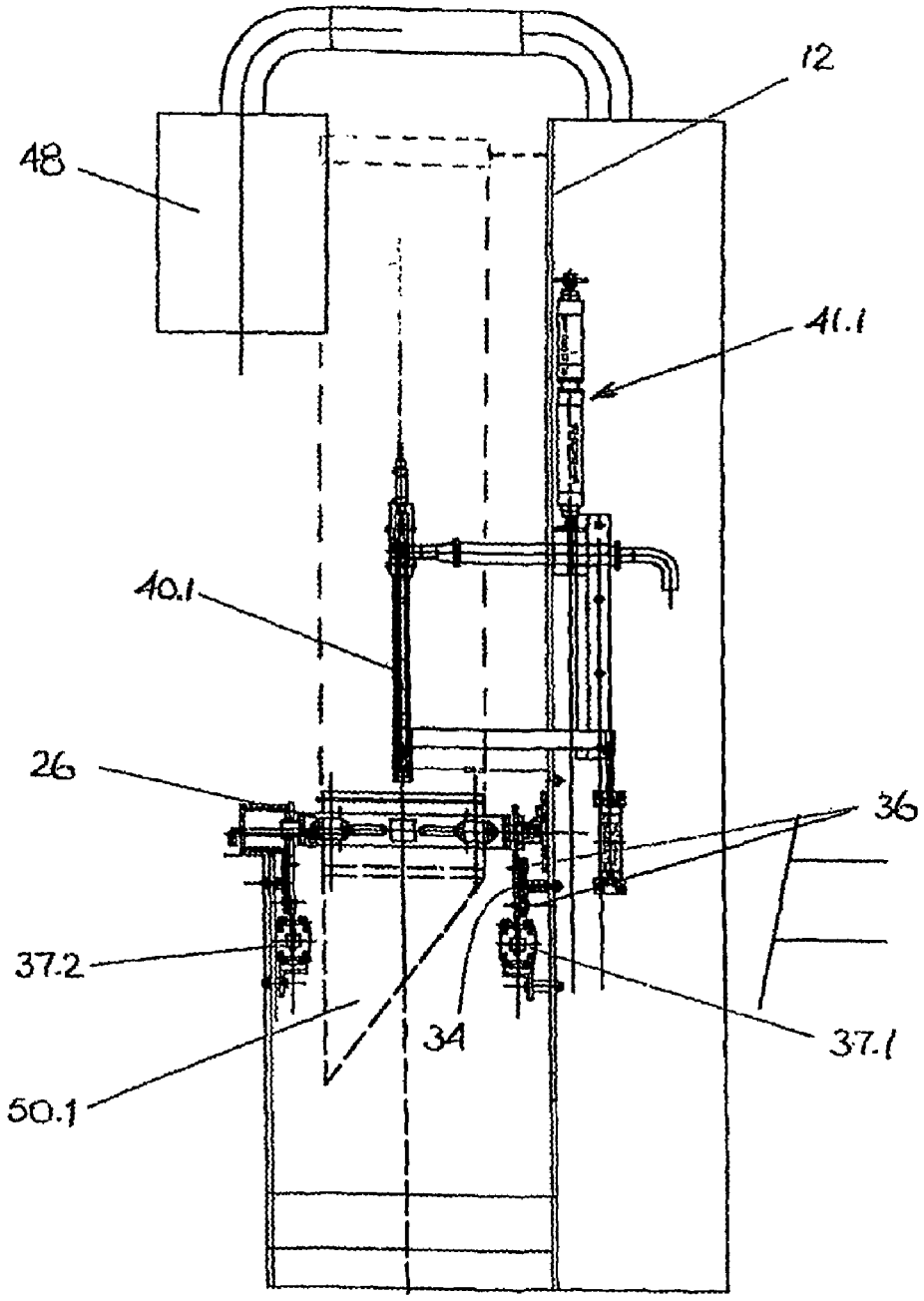
FIG. 2 is a sectional schematic end elevation of the first embodiment.
Figure 3A:
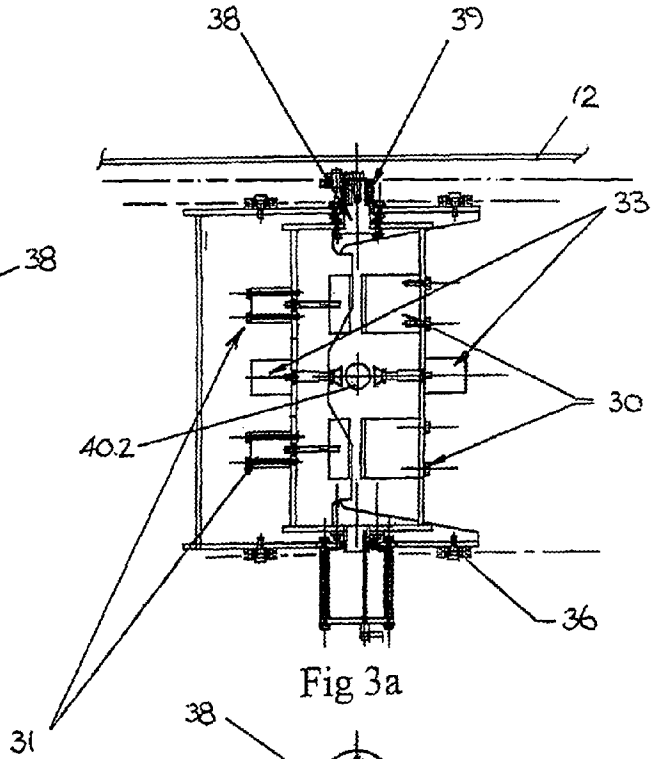
FIGS. 3A, 3B and 3C are top plan, front and end elevational views of a bag carriage from the first embodiment of the present invention.

A similar operation occurs for the second carriage 28, which receives and grips a second bag 50.2 via a set of clamps 30 (see FIG. 3A). However, in this instance the bag is not orientated in the correct position to immediately allow the second filling nozzle to charge the flexible pocket, as depicted in FIG. 2. This is due to the second bag being disposed in opposing relation to the first bag within the supply of packaging film 17. This orientation of adjacent bags prevents unnecessary wastage of the packaging material. Before the second bag 50.2 can be presented to the second filling station 11.2, it is required to be inverted or rotated through 180 degrees to present the filling mouth of the bag to the filling nozzle 40.2 at the second filling station.

Figure 3B:
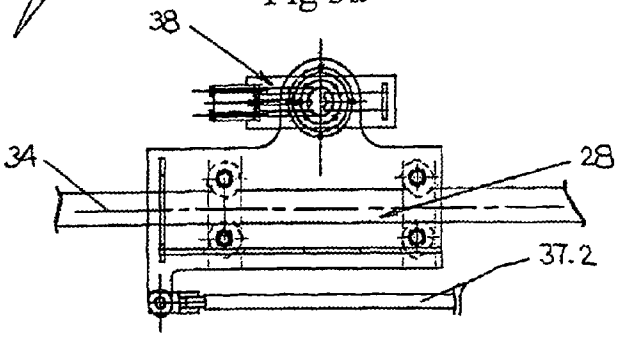
Figure 3C:
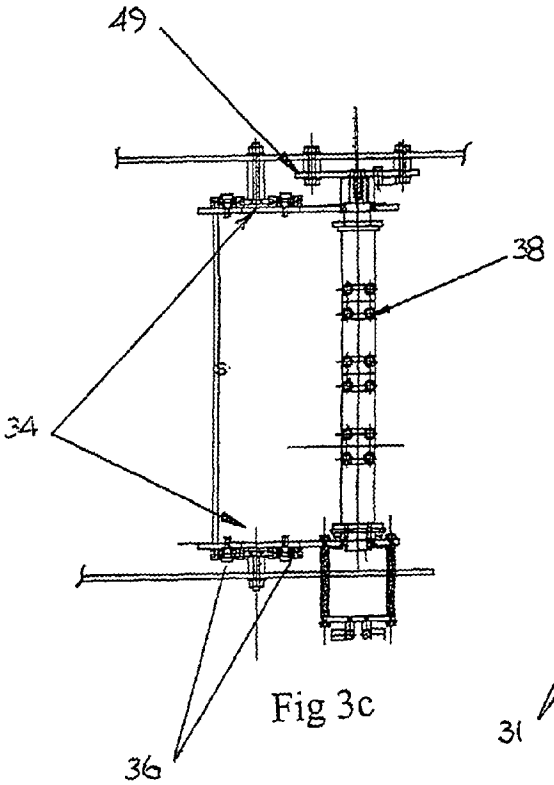

In the present embodiment, the second carriage 28 is fitted with a turn-over mechanism 38 which is depicted in FIGS. 3 and 4, which drawings are discussed in more detail below. The second carriage 28, which includes a bag reversing or inverting sub-assembly 38 to which the clamps 30, vacuum cups 32 and respective fluid actuators 31, 33 are mounted, is depicted in FIGS. 3A, 3B and 3C. Upon reception of the bag by the second carriage 28, vacuum cups 32 engage the outer surface of the bag and then retracted using fluid actuators 33 to draw back opposing wall portions of the bag and open the flexible pocket therein. The turn-over mechanism includes followers, in the form of a pair of bearings 39, mounted on an axial end surface of the sub-assembly 38. As the carriage, is manoeuvred by carriage actuator 37.2 along the track 34 towards the second filling station 11.2, the bearings 39 engage with an elongate camming surface 49 of the turn-over mechanism, causing the mechanism to rotate the second bag 50.2 into the correct position for filling.

Once the second bag is correctly orientated and the filling mouth positioned below the filling nozzle 40", it is then charged with a vicious material from a second reservoir 46.2. In this instance the second reservoir 46.2" may contain the same filling as that of the first 46.1, or it may contain a further desired filing. On completion of the filling step, the carriage 28 with the filled bag is then positioned at the second sealing station by the actuator 37.2. Sealing heads 42.2 are then brought into engagement with the filling mouth of the bag to produce an airtight seal. The carriage may then release the filled sealed bag onto the conveyor 44. During the return stroke of the actuator 37.2, the turn-over mechanism is reset by the camming surface 49 readying the carriage to accept the next bag from the supply.

In instances where the supply of packaging material is not provided with preformed bags but instead a web of plastic tubing in a flattened configuration, the apparatus may further include a forming portion. The forming portion may be provided as an additional guide having its own sealing and cutting device. As the free end of the material supply is gripped via a set of clamps, the sealing member engages the supply producing an oblique seal 52 across the width of the film 17 thereby defining a pair of adjacent bags 50.1 and 50.2. The adjacent bags are disposed in opposing relation to one another, as depicted in FIG. 5 which is discussed in more detail below. The cutting device may then cut the bags from the film 17.

FIG. 2 depicts a sectional end elevation of the filling apparatus 10 of FIG. 1 taken through plane II-II, as such the sealing head 42' is not shown for reasons of clarity. This particular elevation shows the first bag carriage 26 is positioned at the second filling station below filling nozzle 40.1. The second bag 50.2 is shown in the appropriate filling position, having the filling mouth 51 exposed below the filling nozzle 40.2. Also shown in this representation are the carriage rollers 36, which actively engage the carriage track 34.

With reference to FIG. 3A, there is illustrated a top plan view of the second bag carriage 28 showing jaw members of the bag clamps 30 arranged in opposed relation and vacuum cups 32 of a bag opening device disposed between the bag clamps. The vacuum cups are aligned in a co-axial manner allowing them, in operation, to act in unison to separate opposing wall portions of the flexible pocket defined by the bag. A plurality of rollers 36 are provided on the sides of the carriage 28 allowing it to move along track 34 (shown in phantom).

FIG. 3B shows a front elevational view of the second bag carriage with turn-over mechanism 38 and an operating rod of a second carriage actuator 37.2. The actuators respond to the control signals from control unit 48 (see FIG. 2) to correctly position the carriage between the receiving, filling and sealing stations. In the fully retracted state, the actuator positions the second carriage 28 below the free end packaging material supply allowing the jaw members of the clamps 30 to grip the free end of the continuous film 17. As the operating rod of carriage actuator extends from the retracted state, the rollers 36 (shown in phantom) move the carriage along the track 34 (also shown in phantom) first to the second filling station 11.2 and then to the sealing station 13.2.

FIGS. 4A, 4B and 4C depict the operational sequence of the turn-over mechanism for inverting the position of the bag turn-over sub-assembly 38 that is rotatably mounted on the second bag carriage 28. In the sequence shown the turn-over sub-assembly is moving in the direction indicated by the arrow head 43, from the bag supply exit 25 towards the second filling station 11.2. The bearings 39, which are rotatably mounted on the sub-assembly 38, serially engage with an arcuate protuberant portion of the plate 49 forming the camming surface in the embodiment, to effect rotation of the sub-assembly through 180 whilst the carriage 28 is moved along the track 34.

Turning to FIG. 5, there is shown a section of the film of packaging material supplied to the forming portion. As discussed above, in a first embodiment the bags may be preformed with welds and associated perforations in the supply or, in a second alternative embodiment, the sealing member may divide the tubular plastics film into a series of adjacent bags by providing an oblique seal 52 across the width of the film 17 when the film is stationary in the feed chute 20. The individual bags 50 are then successively removed from the free end of the film by an oblique cutting device which makes a first incision 53 along the central line of the seal 52 excising a bag 50.2, which happens to be of the "second" type requiring inversion before filling. Then the cutting device 22 then makes a secondary incision 54 laterally across the width of the supply to remove another bag, which happens to be of the "first" type. The secondary incision provides the filling mouth 51 of the second bag and the next adjacent bag in the supply.

FIG. 6 depicts a bag 50 in its extended state prior to filling. The flexible pocket has been opened with opposing wall portions 50*a* and 50*b* defining a filling mouth 51 with seal 52 along the oblique edge of the bag. Upon filling the mouth of the bag is then sealed using a sealing head 42.1 or 42.2, as appropriate.

FIG. 7 depicts a top plan view of an alternate embodiment of the bag opening mechanism of the present invention. Bag 50 is disposed between gripping clamps 61 and clamping plate 60. The faces 61.1 of clamps 61 and clamping plate 60 are coated with a non-slip material such as polyurethane or other such suitable polymers.

The bag opening mechanism may be provided on the bag carriages 26 and 28 respectively or it may be mounted upon the frame 12 of the filling apparatus as is illustrated in FIG. 8. With reference to FIG. 8, clamping plate 60 and gripping clamps 61 are mounted within cradle assembly 63. The cradle assembly 63 is in turn coupled to the cradle actuator 66 via rod arm 62 and lever arm 67.

Figure 9A:
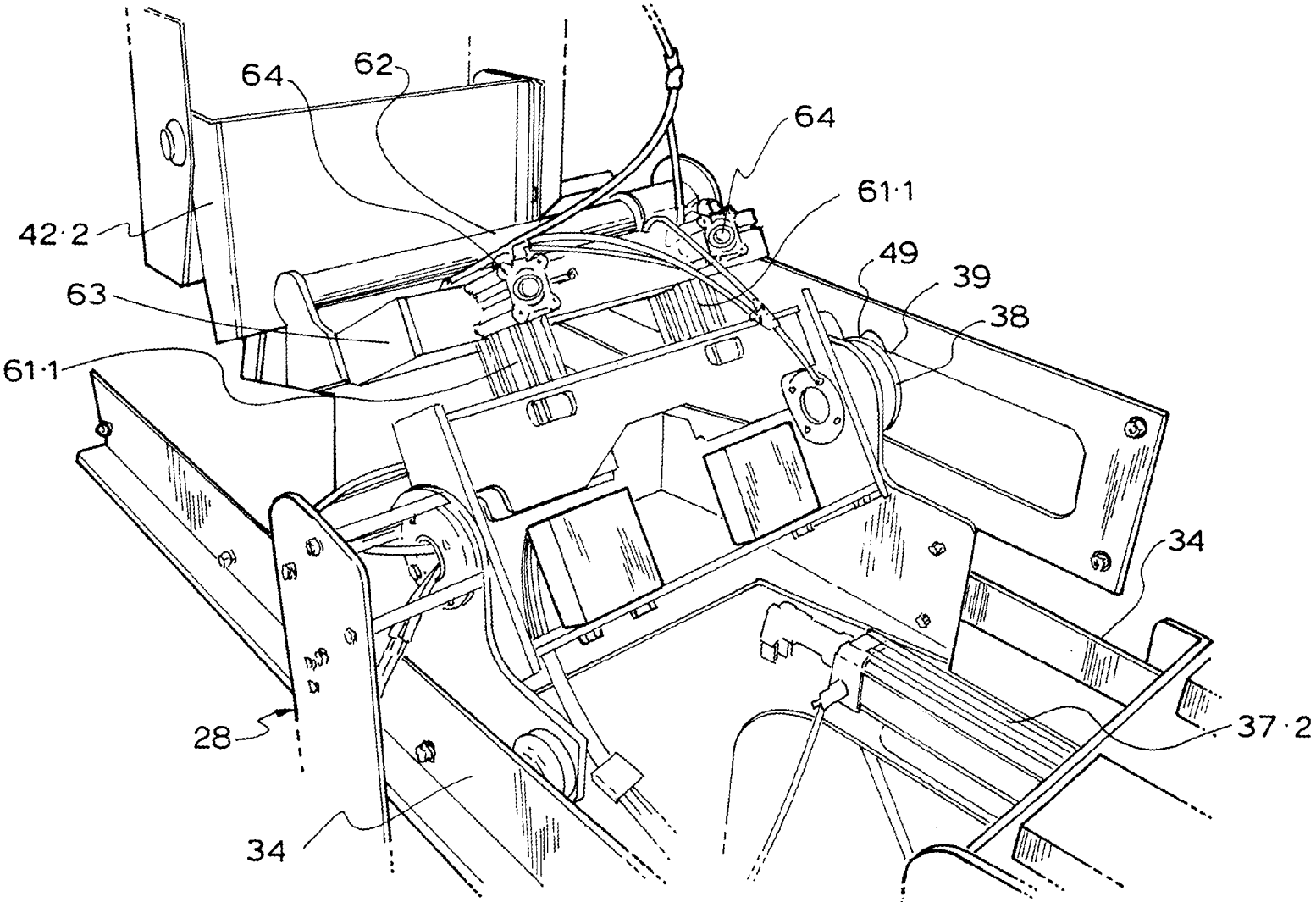

The operation of the opening mechanism of FIG. 8 will be further described with reference to FIGS. 9A-9D. FIG. 9A depicts bag carriage 28 as it is manoeuvred via carriage actuator 37.2 along the carriage track 34 towards the second filling station. Bearings 39 and sub-assembly 38 have engaged camming surface 49 thereby beginning the rotation of carriage 28. Cradle assembly 63 is in an elevated state thereby allowing sufficient clearance for bag carriage to complete the 180 degree rotation to correctly position the second bag 50.2 at the second filing station.

Once the bag carriage 28 and bag 50.2 are positioned at the second filling station cradle assembly actuator 66 (see FIG. 8) is engaged. This displaces lever arm 67 (FIG. 8) which in turn causes rod arm 62 to rotate. Rotation of the rod arm 62 lowers cradle assembly 63 over both the bag carriage 28 and bag 50.2.

Figure 9B:
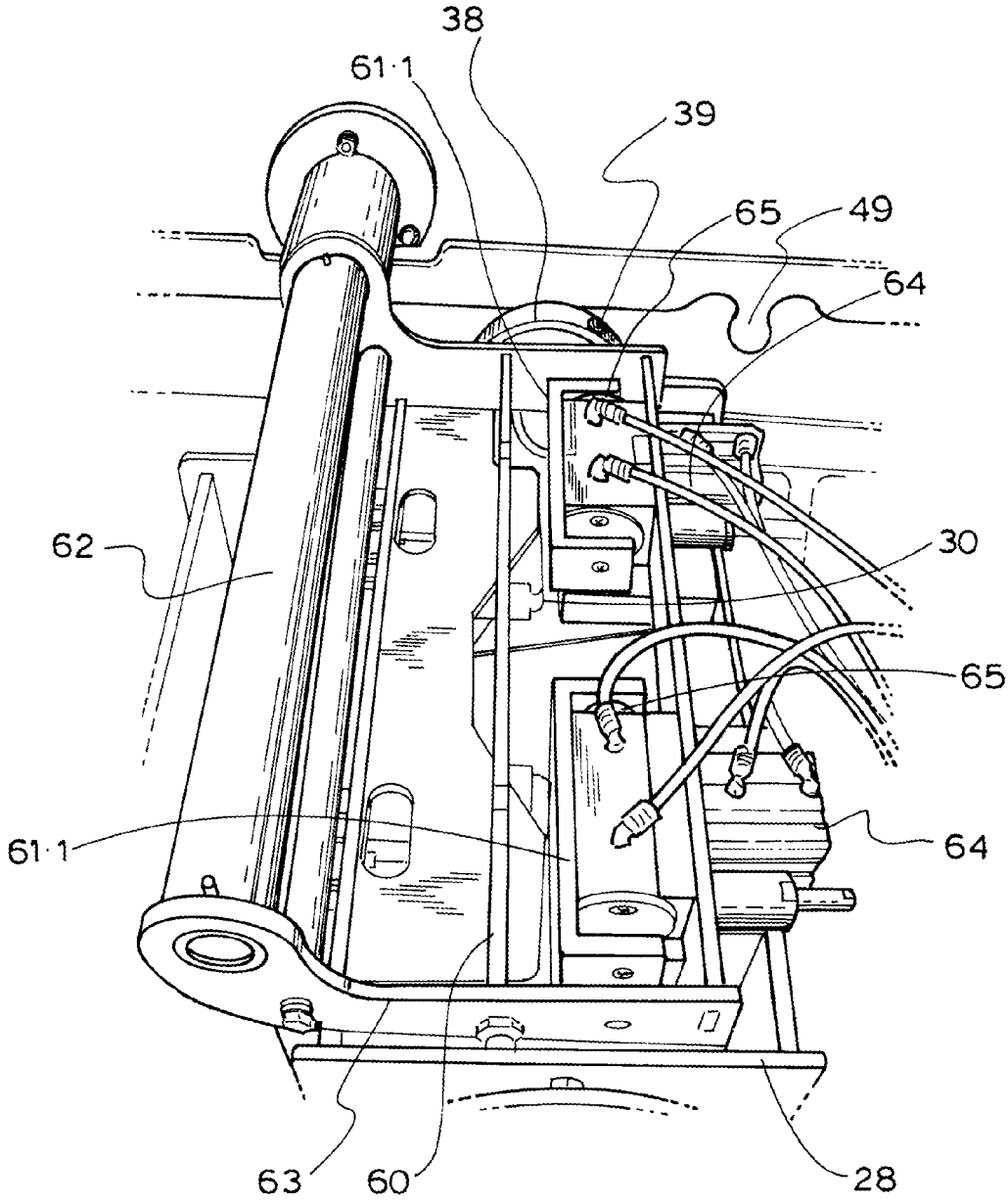

FIG. 9B depicts the opening mechanism in the lowered state, cradle assembly 63 rests upon bag carriage 28 such that an upper portion of bag 50.2 protrudes between the cradle clamps 61 and clamping plate 60. Also shown in FIG. 9B are the cradle clamp faces 61.1, cradle clamp actuators 64 and clamp head cylinders 65.

Figure 9C:
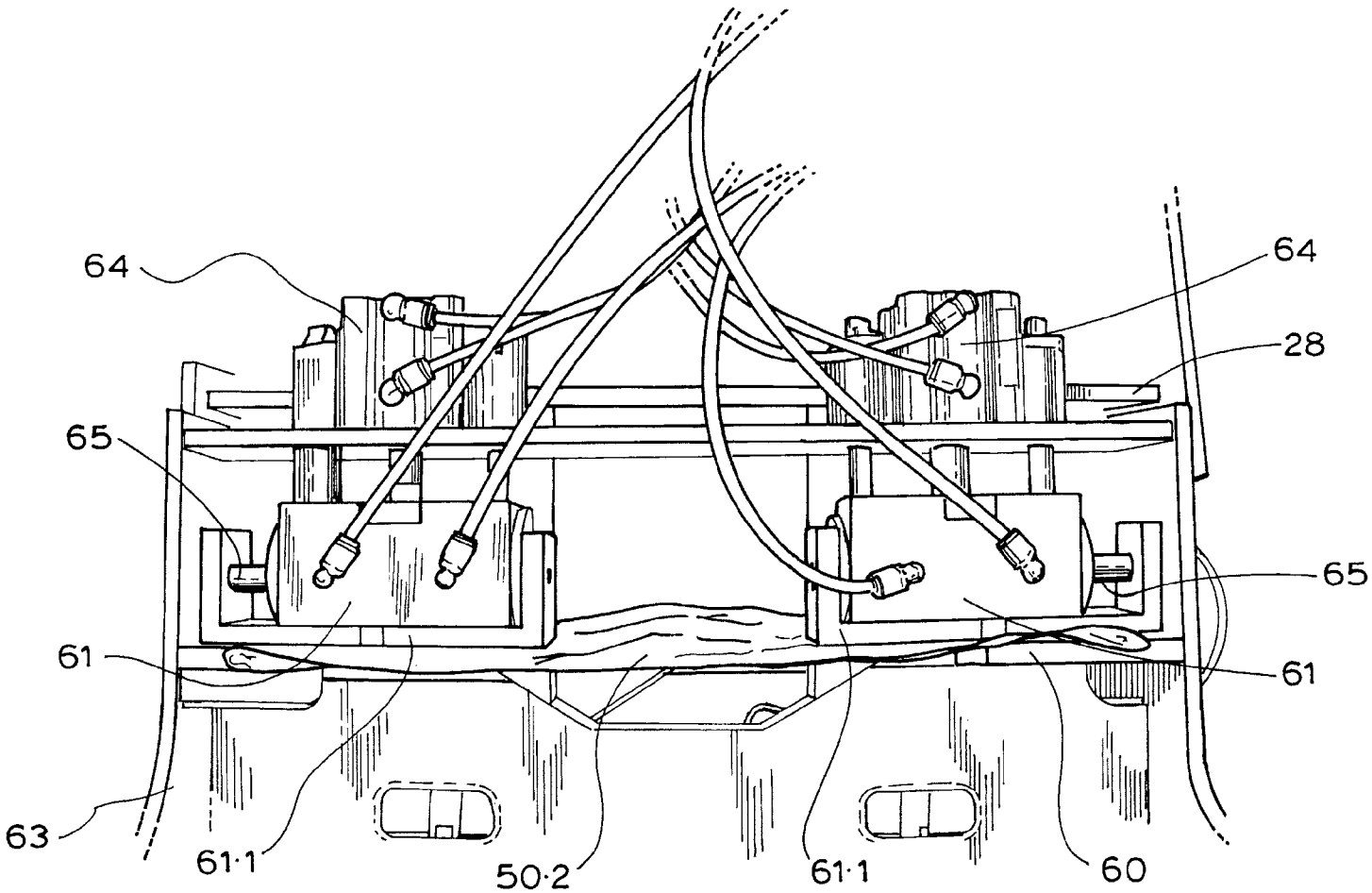

With reference to FIG. 9C, cradle clamps 61 are moved towards the clamping plate 60 via cradle clamp actuators 64, thereby causing clamp faces 61.1 to engage the bag 50.2 and clamp it against the clamping plate 60.

Figure 9D:
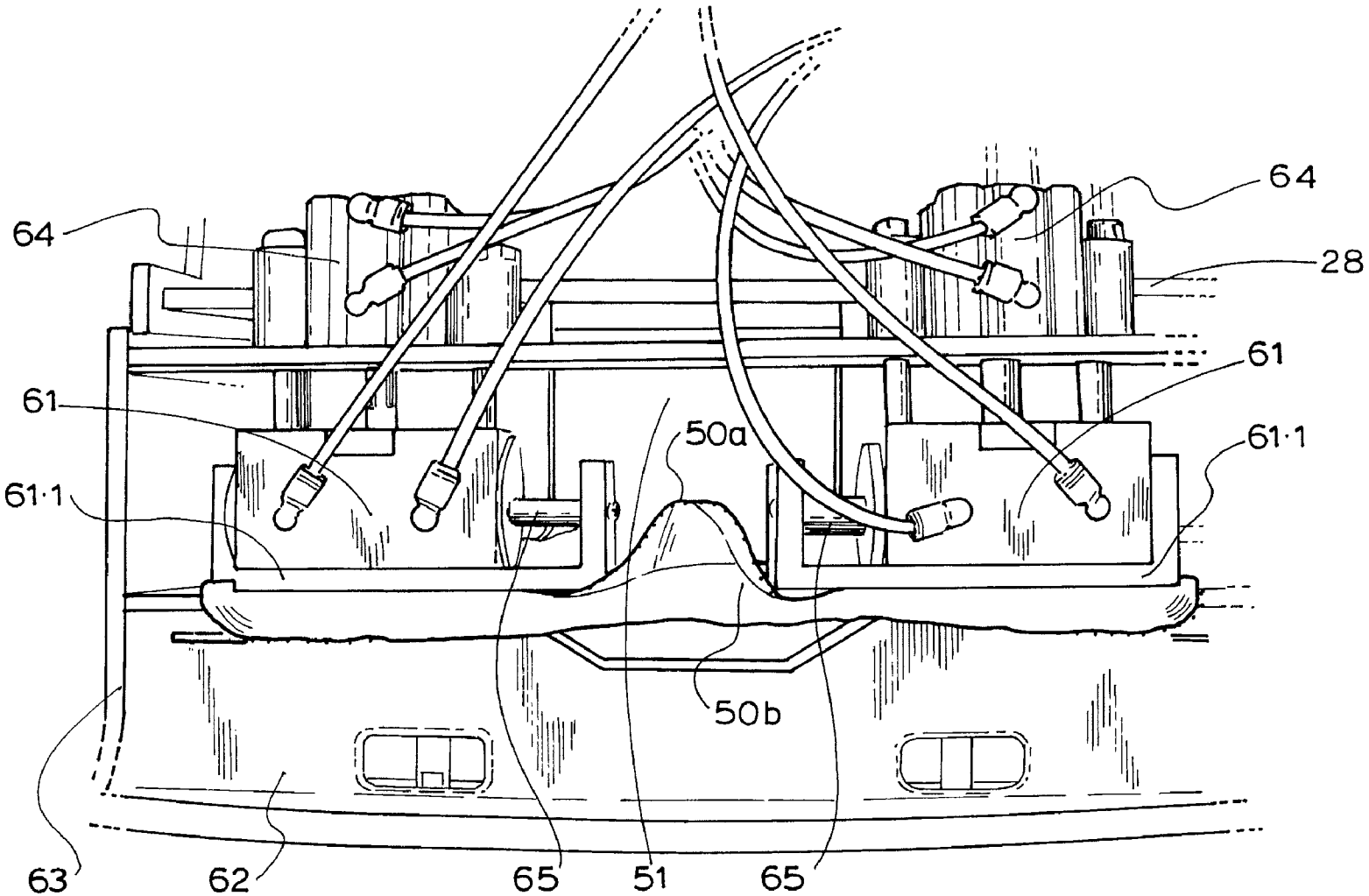

Clamp cylinders 65 are then operated to move the clamps 61 laterally towards one another as shown in FIG. 9D. As the clamp faces 61.1 and the clamping plate 60 are coated with a non-slip coating, the opposing wall portions 50*a* and 50*b* of bag 50.2 are unable to move relative to either the clamping plate 60 or the clamp faces 61.1. This causes ends of wall portion 50*a* to slide across the opposing wall portion 50*b* of the bag, causing wall portion 50*a* to buckle into the gap between the cradle clamps 61. This buckling of the wall portion 50*a* creates the filling a mouth 51 into which filing nozzle 40.2 may then be inserted.

FIG. 10A shows one embodiment of the oblique cutting device 70 of the present invention for cutting bags from the supply. In this instance the cutting device is of a hot wire type, the wire is connected between pins 71 which are mounted on arm 72. However it is to be appreciated that the cutting action need not be performed by a hot wire, the oblique cutting device may employ a blade or other such suitable cutting edge to cut the bag from the supply. The cutting arm 72 is coupled to support member 73 via cutting actuator 74. Support member 73 is secured to a backing plate 75 by mounting brackets 76. The backing plate 75 is then centrally mounted between filling stations 11.1 and 11.2 on frame 12 via brackets 79.

A further view of the oblique cutting device 70 is shown in FIG. 10B. The support member 73 is secured to the backing plate 75 by mounting brackets 76. The cutting arm is mounted to support member 73 via cutting actuator 74 with hot wire 77 being connected between pins 71.

With reference to FIG. 11 there is depicted an embodiment of the bag forming portion 80. In this embodiment the forming portion 80 is mounted on the opposing side of the plate 75 to the oblique cutting device 70. Sealing bars 81 are mounted on sealing arm 82 which is in turn coupled to support member 83 via sealing actuators 84. Support member 83 is secured to the plate 75 via mounting brackets 85. Also shown in FIG. 11 are film clamp 86 and cutter 22.

FIG. 12 shows the forming portion of FIG. 11 in partially assembled state. Cutting plate 75 is shown with feed chute 20, mounting bracket 85 and film clamp 86. Groove 78 allows the passage wire 77 through plate 75 to effect incision 53 along the central line of oblique seal 52. Sealing bars 81 are provided with a matching grove 81.1 to receive wire 77 after it has passed through the film 17.

A more detailed view of the clamp 86 and the cutter 22 are shown in FIGS. 13 and 14 respectively. As shown in FIG. 13, a film clamp 86 is disposed along a lateral edge of the cutting plate 75. Film clamp actuators 87 are mounted on clamping bar 86.1 and are coupled to clamping jaw 86.2. Engaging actuators 37 moves jaw 86.2 towards the plate 75, thereby clamping the free end of the film 17 between the jaw 86.2 and plate 75.

FIG. 14 shows a cutter 22 including a moveable cutting head 90 carrying a blade 91. The cutting head 90 is secured to secondary cutting actuator (not shown) via struts 92. The blade 91 is secured to the cutting head by screws 93 and is positioned within cutting groove 94. The clamping of the film 17 by the film clamp exposes a region of the film to groove 94 and blade 91 for subsequent cutting.

During the bag forming process, the free end of the material supply 17 is gripped via film clamp 86, the sealing actuators 82 are engaged pressing sealing bars 81 against the supply producing an oblique seal 52 across the width of the film 17 thereby defining a pair of adjacent bags 50.1 and 50.2. The bags are then removed from the free end of the film 17 by the combination of the oblique cutting device 70 and the cutter 22. The cutting actuator 74 is engaged bringing hot wire 77 into contact with film 17 through groove 78. This creates the first incision 53 along the central line of the seal 52 excising a bag. Film clamp 86 positions the free end of the supply against grove 94. The cutting device 22 then moves laterally along grove 94 along the width of the supply thereby causing blade 91 to make the secondary incision 54 to remove the next bag from the supply.

Turning to FIGS. 15 to 19, there is illustrated a bag forming and filling apparatus 100 of a second embodiment of the invention, which embodiment includes a rotary bag carriage arrangement. The apparatus includes a base frame 102 having a support 104 for a supply of packaging material provided on a roll 106. The packaging material is here in the form of a tubular web of plastics film 108 which is drawn form the roll 106 by an in-feed assembly 110. The base frame 102 provides an enclosure or cabinet for further operational assemblies, which enclosure includes a number of doors 103 providing access to the interior. When opened, the doors would trigger a cut-out mechanism for safety reasons. It should be appreciated that electric and pneumatic control lines for the operational assemblies are omitted for reasons of clarity.

Further views of the apparatus 100 are shown in FIGS. 20A and 20B, including a control panel 107 which coordinates packaging operations. FIG. 20A is a front elevation omitting the doors 103 for clarity, whilst FIG. 20B is a top plan which omits a reservoir 390 (see plan view in FIG. 15) which supplies fillings desired to be packaged. The operation of the in-feed assembly 110 for the packaging material is described in more detail with reference to FIG. 21, which also depicts a linear bag feed assembly 150 including a drive mechanism and lateral cutting device.

The apparatus 100 further includes a turntable assembly 200 having a plurality of bag carriages 210, 220, 230, 240, 250, 260 mounted on a turntable assembly 200, as also shown in FIG. 22. A transport drive means 202 in the form of an electric motor 203 coupled to a reducing gearbox 204 operates the turntable drive shaft 206 via a pulley and drive belt arrangement 208, as shown in FIG. 17. Each of the bag carriages further includes a grip sub-assembly 270 for handling individual bags, as exemplified in FIG. 23.

The bag forming and filling apparatus 100 further includes a bag forming assembly 300 associated with the bag feed assembly 150. The bag forming assembly 300 is provided for forming oblique seams, for example by plastic welding using a crush sealing device, in the tubular web 108 of packaging material. The crush sealing device is also arranged for cutting individual bags 50 from the web for individual handling by grip sub-assemblies 270 of the bag carriages. The operation of the bag forming assembly 300 is further described with reference to FIG. 24.

The apparatus 100 also includes a pair of filling stations 400, 450 which include respective foot valves 402, 452 coupled to a pump assembly 350. The pump assembly, which described in further detail in relation to FIG. 25, includes dual pistons for feeding the foot valves from reservoir 390, which may be filled with a viscous comestible.

The apparatus 100 further includes a pair of bag sealing stations 500, 550 to which bags filled with the comestible are presented by the grips 270 for sealing purposes. The operation of an exemplary sealing station 500 is described in more detail with reference to FIG. 27.

Turning to FIG. 21, the in-feed assembly 110 includes a sub-frame 112 carrying support 104 which support takes the form of a de-coiler shaft in the embodiment. The tubular web 108 is drawn from the roll 106 by the bag feed sub-assembly 150, the rotation of which roll is controlled by a friction clutch. The Web 108 is routed through a guide system, including over two idler rollers 114, 116 and through a pair of dancer sub-assemblies 118, 120, each dancer including pivoting arms with rollers at respective ends thereof, and between a pair of frictional in-feed rollers 122.1, 122.2. The in-feed rollers each include a one-way clutch so as to maintain tension in the web in opposition to the friction clutch of the roll 106. The sub-frame 112 also supports a lateral cutting device 124 and an associated hinged panel 126 which lifts a free end of the web 108 for presentation to a gripper 154.

The associated bag feed assembly 150 includes a shuttle 152 having a gripper 154 for the free end of the web 108. The shuttle travels along a track 156 under the control of an actuator 162, which track is supported at each end by brackets 158, 160 mounted to the base frame 102, as depicted in FIG. 20A. The shuttle 152 is dimensioned to travel between clamps or jaws 273 of opposed bag carriages, for example carriages 220 and 250 in FIG. 22. The clamps or jaws of the carriages are held open during bag feed allowing the web to be passed therebetween.

The turntable assembly 200 provides a transport assembly supporting six (6) bag carriages for rotary motion, 3 carriages 210, 220, 230 being depicted on one side of the apparatus in FIG. 22. It will be appreciated that an alternative embodiment transport means may include separate bag carriages arranged for independent motion on a circular track or guide, as required. The turntable in the embodiment includes a hexagonal space frame 280 mounted on the drive shaft 206, which frame is covered by a frustro-conical body 282. The body is provided for guiding falling bags onto a take-away conveyor (not shown) when the bags are released after filling and sealing operations at respective stations 400, 450 and 500, 550. Upright support members or posts 212, 222, 232, 242 are provided for respective grip sub-assemblies 214, 224, 234, 244, mounted between upper ends of adjacent posts. Each grip sub-assembly includes gripper jaws, suction cups and actuators for manipulating individual bags as described in further detail in relation to FIG. 23.

A bag gripping carriage 220 is illustrated in FIG. 23 having a turning actuator 271 for the gripper sub-assembly 270 coupled to support post 272. The sub-assembly includes two (2) gripper jaw sets 273.1, 273.2 controlled by respective gripper actuators 275.1, 275.2. Pneumatic suction cups 276.1, 276.2 and respective bag opening actuators 277.1, 277.2 are provided for drawing opposed walls of a bag apart to open the bag by forming a mouth for filling purposes. A further pair of actuators 278.1, 278.2 are provided for moving the sets of jaw inwardly and outwardly relative to one another in order to assist in distorting the bag open for filling, as necessary. Suitably, the sets of gripper jaws are moved inwardly by actuators 278 in order to distort open the mouth 51 of a bag 50. If required a puff of gas may be employed to assist in opening the bag mouth.

Turning to FIG. 24, there is shown an example of a film sealing or welding sub-assembly 300 which is mounted for movement in a horizontal plane in the embodiment. A first pair of tubular guides 302.1, 302.2 supports an x-y mounting plate 301 of the sub-assembly for motion parallel to the bag feed track 156 (see also FIG. 20B). A second pair of tubular guides 304.1, 304.2 supports the spring mounted ejector bars 305, 306 and crush seal/cutter sub-assembly 312, 314 for motion normal to the bag feed track 156. The crush seal/cutter assembly includes a heater bar 312, having a central cutting edge and tapering shoulder portions forming heating elements for sealing bag edges on either side of the cut. The crush seal/cutter sub-assembly also has an opposing Teflon tape covered foam strip 314 for backing the web 108 upon application of the heater bar 312. Furthermore, and in order to allow adjustment of the oblique angle at which the welding bars address the web of packaging film, the backing plates 307, 308 may be manually adjusted via the tubular guides and locked in place by lock nut 311.

The heater bar 312 and Teflon covered foam strip 314 are brought together by actuators 309, 310, such as pneumatic cylinders. As shown in FIG. 24, the backing plates may be withdrawn from one another by the actuators to allow the shuttle to pass therebetween. In operation, the gripper 154 on shuttle 152 grips a free leading end of the tubular web and feeds or draws in a predetermined length of the web equivalent to two (2) opposing bags. Upon severing the length by lateral cutter 124, the shuttle may draw the cut length of web a little further so that the trailing end of the cut length may be gripped by the jaws 273 of the carriage 250 (see FIG. 20A) adjacent to the lateral cutter 124 and/or to provide clearance for the bag forming sub-assembly 300.

Subsequently, and with reference to FIG. 5, the cutting/sealing head 312 and foam backing 314 are brought together for a predetermined time to provide an oblique seal 52 across the length of web and also sever first and second bags 50.1, 50.2 from one another along the oblique seal. The shuttle then travels a further distance necessary to deliver the second bag 50.2 to the jaws of the carriage 220 on the opposite side of turntable frame 282 (see FIG. 20B), noting that a top edge of the first bag 50.1 remains in the jaws of the carriage 250 adjacent the lateral cutter, as described above.

The pump sub-assembly 350 is depicted in FIG. 25, whilst FIG. 16 includes a partially sectional view illustrating some internal components of the pump. With reference to FIG. 16, the pump is of the positive displacement type operating under servo control and includes a first pump tube 360 and a second pump tube 370 with respective pistons 362, 372. The pump includes three end caps 351, 352, 353 relating to the pump tubes, together with inlet/outlet fittings 354, 355, 356, 357 associated with the end caps. The pump includes a linear motor adapter 358, and is mounted to the base frame 102 by sub-frame members 359.1, 359.2. A linear actuator 380, such as motor model GSX40 manufactured by Exlar Corporation of Chanhassen Minn., USA is used to drive the pistons via piston rods (not shown) in order to supply the foot valve assemblies 400, 450.

The foot valve assembly, such as the example 400 illustrated in FIG. 26, include a footvalve 402 and an actuator 410. The footvalve has a body 403, a cylinder mount 404 for cylinder 405, together with an outlet or nozzle covered by a shroud 406 that prevents any of the fillings touching the side of the bag to be sealed. The foot valve nozzle is lowered by cylinder 405 once inside the bag, and is not visible in this drawing. The actuator is suitably a linear motor, for example an Exiar model SR21-12:1. The footvalve 402 is fixed to a support plate 415 which plate is slidably mounted relative to the base plate by sleeve members 412 provided on a guide rod 413. The guide rod 413 is fixed to and extends upwardly from the base plate 411. The rod of actuator 410 bears on support plate to lower the outlet 406 into the open mouth of a bag, for dispensing selected amounts of comestible under control of the main pump 350.

Turning finally to FIG. 27, there is shown a bag sealing and lifting mechanism 500 which includes a pivot plate 502 having a Teflon strip 504 at its free end, which strip is arranged for cooperation with a heated bar 506 having impulse type electrical heating elements 507 to seal the mouth of a filled bag presented by a gripper sub-assembly 270 of any bag carriage. The pivot plate 502 is pivotally mounted to a pivot bracket 508 and actuated by rear cylinder 510. A further actuator 532 is provided for moving the heated bar 506 and pivot plate 502, which are slidably mounted to mounting plate 522 via guide rods 534, toward the upper edge of a filled bag (not shown).

The mechanism also includes a bag push sub-assembly including a push pivot arm 512 actuated at one end by a push cylinder 514 and having a pusher plate 520 and a pair of guide rods 516 at an opposite end. The pusher plate engages a side wall of the filled bag aiming to expel air from above the viscous product therein prior to sealing the bag. The guide rods include buffers 518 at one end thereof. A mounting plate 522 for the sub-assembly is fixed to a pair of rods 524 which are slidably mounted in guide members 526 which are in turn fixed to a support plate 528 on the base frame 102. An actuator 530 is provided for lifting the sealing mechanism and bag pushers out of the path of the carriages during rotation of the turntable 282 to deliver the next filled bag for sealing.

It is to be understood that the above embodiments have been provided only by way of exemplification of this invention, and that further modifications and improvements thereto, as would be apparent to persons skilled in the relevant art, are deemed to fall within the broad scope and ambit of the present invention described herein and defined in the following claims.

The invention claimed is:

1. A method of producing and filling flexible bags with a viscous product for piping or decorating purposes, said method including the steps of:

a) providing a plurality of bags from a supply, wherein successive first and second adjacent bags in the supply are disposed in opposing longitudinal relation to one another;

b) gripping and cutting a first bag obtained from the supply;

c) carrying the first bag from the supply to a first filling station, then:

(i) opening and filling said first bag with the viscous product at the first filling station; and (ii) sealing and releasing the filled first bag, before moving to the supply of bags for further first bag;

d) gripping and cutting a second bag obtained from the supply;

e) carrying the second bag from the supply to a second filling station; then:

(i) opening and filling the second bag with the viscous product at the second filling station; and (ii) sealing and releasing the second filled bag, before moving to the supply of bags for a further second bag.

2. The method of claim 1 wherein the second bag is inverted during the step of carrying the second bag from the supply to the second filling station.

3. The method of claim 1 wherein the step of providing a plurality of bags includes provision of flexible packaging material in the form of either a series of pre-formed bags disposed in a continuous web or individual bags held in a magazine arrangement.

4. The method of claim 1 wherein the step of providing a plurality of bags includes the step of forming the bags from the supply comprising a tubular web.

5. The method of claim 4 which forming step includes a sealing step whereby the continuous supply is divided into adjacent bags each sharing a common transverse seal along opposing oblique edges.

6. The method of claim 1 further including the step of printing images or indicia on the plurality of bags provided on the supply, prior to cutting bags from the supply.

7. The method of claim 1 wherein the carrying step involves rotary motion, provided by a plurality of bag carriages.

8. The method of claim 7 wherein the plurality of bag carriages are mounted on a common turntable and alternate carriages are assigned to respective first and second bags.

9. The method of claim 1 wherein the carrying step involves linear motion, provided by first and second transporters for respective first and second bags.

10. The method of claim 9 wherein the first transporter and the second transporter reciprocate independently on a common track.

11. A method of producing and filling flexible bags with a viscous product for piping or decorating purposes, said method including the steps of:

a) providing a plurality of bags from a supply, wherein successive first and second adjacent bags in the supply are disposed in opposing longitudinal relation to one another;

b) gripping and cutting a first bag obtained from the supply;

c) carrying the first bag cut from the supply to a first filling station, then:

(i) opening and filling said first bag with the viscous product at the first filling station; and (ii) sealing and releasing the filled first bag, before moving to the supply of bags for further first bag;

d) gripping and cutting a second bag obtained from the supply, followed by inverting said second bag;

e) carrying the second bag from the supply to a second filling station, then:

(i) opening and filling the second bag with the viscous product at the second filling station; and (ii) sealing and releasing the second filled bag, before moving to the supply of bags for a further second bag.

12. The method of claim 11 wherein the step of providing a plurality of bags includes provision of flexible packaging material in the form of either a series of pre-formed bags disposed in a continuous web or individual bags held in a magazine arrangement.

13. The method of claim 11 wherein the step of providing a plurality of bags includes the step of forming the bags from the supply comprising a tubular web.

14. The method of claim 13 which forming step includes a sealing step whereby the continuous supply is divided into adjacent bags each sharing a common transverse seal along opposing oblique edges.

15. The method of claim 11 further including the step of printing images or indicia on the plurality of bags provided on the supply, prior to cutting bags from the supply.

16. The method of claim 11 wherein the carrying step involves rotary motion, provided by a plurality of bag carriages.

17. The method of claim 16 wherein the plurality of bag carriages are mounted on a common turntable and alternate carriages are assigned to respective first and second bags.

18. The method of claim 11 wherein the carrying step involves linear motion, provided by first and second transporters for respective first and second bags.

19. The method of claim 18 wherein the first transporter and the second transporter reciprocate independently on a common track.

* * * * *